US012396613B2

(12) United States Patent
Ahmed et al.

(10) Patent No.: US 12,396,613 B2
(45) Date of Patent: Aug. 26, 2025

(54) STEAM CLEANING APPARATUS

(71) Applicant: SHARKNINJA OPERATING LLC, Needham, MA (US)

(72) Inventors: Fariha Ahmed, Needham, MA (US); Joshua Redman, Needham, MA (US); Peter Hutchinson, Needham, MA (US); Dmitry Layevsky, Needham, MA (US); Andrew Keene, Needham, MA (US); Kai Xu, Suzhou (CN); Ognjen Vrdoljak, Quebec (CA); Queena Tan, Needham, MA (US); Devin Feng, Suzhou (CN); Junping Li, Needham, MA (US); Ming Yao, Suzhou (CN); Tao Wang, Needham, MA (US); Hui Zou, Needham, MA (US); Yonggang Li, Needham, MA (US); David T. Barker, Snaith (GB); Heliang Chen, Suzhou (CN); Jibing Gu, Needham, MA (US); Mingliang Qin, Needham, MA (US); Zhengzhou Lu, Needham, MA (US); Lei Liu, Needham, MA (US)

(73) Assignee: SHARKNINJA OPERATING LLC, Needham, MA (US)

( * ) Notice: Subject to any disclaimer, the term of this patent is extended or adjusted under 35 U.S.C. 154(b) by 0 days.

(21) Appl. No.: 17/726,666

(22) Filed: Apr. 22, 2022

(65) Prior Publication Data

US 2022/0338703 A1 Oct. 27, 2022

Related U.S. Application Data

(60) Provisional application No. 63/220,272, filed on Jul. 9, 2021, provisional application No. 63/178,932, filed on Apr. 23, 2021.

(51) Int. Cl.
*A47L 11/40* (2006.01)
*A47L 11/16* (2006.01)

(52) U.S. Cl.
CPC ..... *A47L 11/4086* (2013.01); *A47L 11/161* (2013.01); *A47L 11/4011* (2013.01); *A47L 11/4069* (2013.01)

(58) Field of Classification Search
CPC ..... A47L 11/161; A47L 11/164; A47L 11/34; A47L 11/4008; A47L 11/4011;
(Continued)

(56) References Cited

U.S. PATENT DOCUMENTS 5,806,132 A * 9/1998 Kelley ..... A47L 11/4069 451/353
6,289,551 B1 9/2001 Basile
(Continued)

FOREIGN PATENT DOCUMENTS

CN 206044549 U 3/2017
CN 206910301 U * 1/2018
(Continued)

OTHER PUBLICATIONS

Translation of KR-20030041569-A (Year: 2003).*
(Continued)

*Primary Examiner* — David S Posigian
*Assistant Examiner* — Steven Huang
(74) *Attorney, Agent, or Firm* — Mintz, Levin, Cohn, Ferris, Glovsky and Popeo, P.C.

(57) ABSTRACT

A steam cleaning apparatus may include a wand, a cleaning assembly coupled to the wand, the cleaning assembly including a steam generator, and a cleaning head pivotally coupled to the wand. The cleaning head may include a plurality of cleaning pads, a pad motor having a motor driveshaft, a drivetrain configured to transfer rotational
(Continued)

motion of the motor driveshaft to each of the plurality of cleaning pads such that a rotation of the motor driveshaft causes a corresponding rotation in each of the plurality of cleaning pads, and a temperature sensor positioned proximate to the drivetrain, the temperature sensor being configured to measure a temperature of the drivetrain.

14 Claims, 19 Drawing Sheets

(58) Field of Classification Search
CPC A47L 11/4063; A47L 11/4069; A47L 11/408; A47L 11/4086; A47L 11/4088; A47L 13/20; A47L 13/26
See application file for complete search history.

(56) References Cited

U.S. PATENT DOCUMENTS

| | | | | |
|---|---|---|---|---|
| 7,640,626 | B2 | 1/2010 | Oh | |
| 8,677,552 | B2 | 3/2014 | Krebs | |
| 11,297,995 | B2 | 4/2022 | Weeks et al. | |
| 2004/0034953 | A1* | 2/2004 | Huang | A47L 11/4069 15/98 |
| 2006/0101605 | A1 | 5/2006 | Fujiwara | |
| 2007/0029870 | A1* | 2/2007 | Smith | B60B 37/10 301/113 |
| 2008/0189900 | A1* | 8/2008 | Milanese | A47L 13/225 15/322 |
| 2010/0126533 | A1* | 5/2010 | Nottingham | A47L 13/22 134/105 |
| 2013/0318725 | A1* | 12/2013 | Kellis | A47L 11/34 134/6 |
| 2014/0259515 | A1* | 9/2014 | Nuttall | A47L 11/4088 15/322 |
| 2016/0367100 | A1* | 12/2016 | Tran | A47L 11/4011 |
| 2017/0156557 | A1* | 6/2017 | Fujita | B05B 13/0421 |
| 2020/0129034 | A1* | 4/2020 | Krebs, Jr. | A47L 13/225 |

FOREIGN PATENT DOCUMENTS

| | | | | | |
|---|---|---|---|---|---|
| CN | 209236053 | U | * | 8/2019 | A47L 13/225 |
| CN | 110448247 | A | * | 11/2019 | |
| CN | 209836885 | U | * | 12/2019 | |
| CN | 210446924 | U | * | 5/2020 | |
| CN | 211511655 | U | * | 9/2020 | |
| DE | 102010039529 | A1 | * | 2/2012 | B60S 1/166 |
| KR | 950008618 | B1 | * | 8/1995 | |
| KR | 20030041569 | | | 5/2003 | |
| KR | 20030041569 | A | * | 5/2003 | |
| KR | 101609444 | B1 | * | 4/2016 | |
| WO | WO-2022212120 | A1 | * | 10/2022 | |

OTHER PUBLICATIONS

Translation of CN-210446924-U (Year: 2020).*
Translation of CN 211511655 U (Year: 2020).*
Translation of CN-110448247-A (Year: 2019).*
Translation of KR 101609444 B1 (Year: 2014).*
Translation of CN 206910301 U (Year: 2018).*
Translation of CN 209836885 U (Year: 2019).*
Translation of KR 950008618 B1 (Year: 1995).*
Translation of DE102010039529A1 (Year: 2012).*
Translation of DE102010039529A1, fig. 9 (Year: 2012).*
Translation of CN 209236053 U (Year: 2019).*
PCT Search Report and Written Opinion, mailed Sep. 2, 2022, received in corresponding PCT Application No. PCT/US22/25873, 11 pages.
Partial Supplementary European Search Report received for European Patent Application No. 22792544.3, mailed on Aug. 5, 2024, 14 pages.

* cited by examiner

STEAM CLEANING APPARATUS

CROSS-REFERENCE TO RELATED APPLICATIONS

The present application claims the benefit of U.S. Provisional Application Ser. No. 63/178,932 filed on Apr. 23, 2021, entitled Steam Cleaning Apparatus and U.S. Provisional Application Ser. No. 63/220,272 filed on Jul. 9, 2021, entitled Steam Cleaning Apparatus, each of which are fully incorporated herein by reference.

TECHNICAL FIELD

The present disclosure generally relates to surface cleaning devices and more specifically to steam cleaning apparatuses.

BACKGROUND INFORMATION

Surface treatment apparatuses can be configured to clean one or more surfaces (e.g., a floor). Surface treatment apparatuses may include, for example, a vacuum cleaner, a mop, a steam cleaning apparatus, a powered broom, and/or any other surface treatment apparatus. A steam cleaning apparatus can include a steam generator, a pad through which steam passes, and a handle for maneuvering the pad along a surface to be cleaned. In some instances, the pad may be agitated (e.g., moved laterally and/or rotationally).

BRIEF DESCRIPTION OF THE DRAWINGS

These and other features and advantages will be better understood by reading the following detailed description, taken together with the drawings wherein.

DETAILED DESCRIPTION

The present disclosure is generally directed to a surface treatment apparatus (e.g., a steam cleaning apparatus). One example of a steam cleaning apparatus may include a cleaning head, a wand having a handle pivotably coupled to the cleaning head, and a steam generator configured to generate steam. The cleaning head includes a plurality of rotating cleaning pads and a pad motor configured to cause each of the rotating cleaning pads to rotate. The cleaning head is fluidly coupled with the steam generator such that steam can pass through each of the plurality of cleaning pads. The pad motor is connected to a drivetrain such that the pad motor can cause each of the cleaning pads to rotate.

In some instances, the drivetrain includes a worm coupled to the pad motor, the worm being configured to engage corresponding gears. In this instance, engagement between the worm and the corresponding gears may result in elevated temperatures within the drivetrain (e.g., due to rotational speed of the worm). As such, one or more temperature sensors may be positioned proximate to the drivetrain (e.g., proximate to the worm). The one or more temperature sensors are configured to monitor a temperature within the drivetrain. In response to the monitored temperature exceeding a threshold, the pad motor may be disabled. Such a configuration may mitigate damage caused to the drivetrain resulting from increased temperatures.

In some instances, the drivetrain includes one or more bevel gears. For example, a motor bevel gear may be coupled to the pad motor and the motor bevel gear may be configured to engage with a drive bevel gear. In this instance, temperature rise may be mitigated when compared to a drivetrain having a worm coupled to the pad motor.

Figure 1:
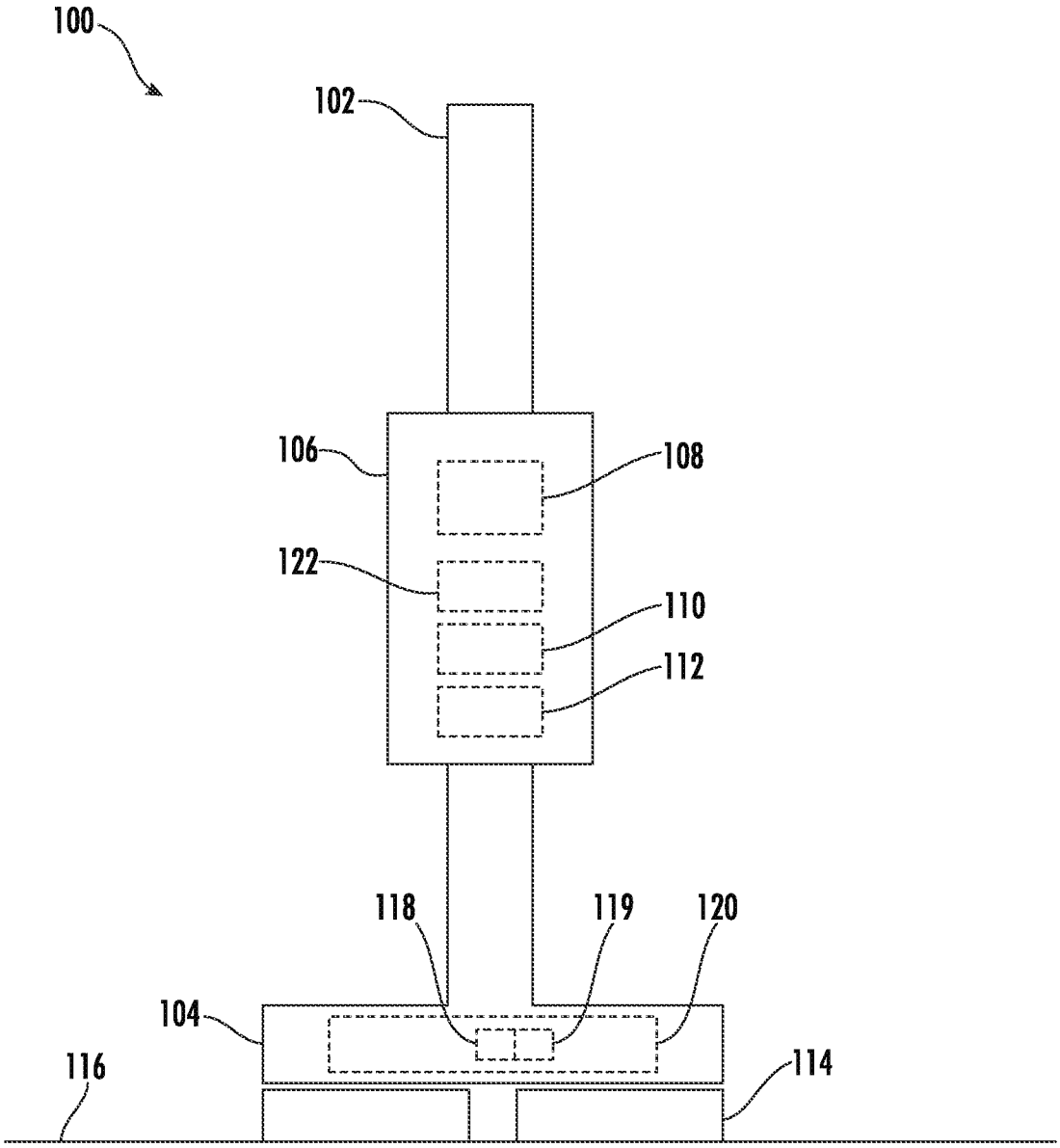
FIG. 1 shows a schematic example of a steam cleaning apparatus, consistent with embodiments of the present disclosure.

FIG. 1 shows a schematic example of a steam cleaning apparatus 100. As shown, the steam cleaning apparatus 100 includes a wand 102 pivotally coupled to a cleaning head 104. The wand 102 may be pivotally coupled to the cleaning head 104 through a swivel joint. For example, the wand 102 may be pivotable between a storage position (e.g., a vertically extending position) and an in-use position (e.g., a reclined position) about a first pivot axis and may be pivotable between a centered position and one or more side positions (e.g., a left side position and a right side position) about a second pivot axis. One or more components of the steam cleaning apparatus 100 may be electrically coupled to a power source (e.g., a mains power source or a battery power source).

A cleaning assembly 106 is coupled to the wand 102. The cleaning assembly 106 may include, for example, a liquid (e.g., water) reservoir 108, a pump 110 fluidly coupled to the liquid reservoir 108, and a steam generator 112 fluidly coupled to the liquid reservoir 108. In operation, the pump 110 is configured to urge liquid from the liquid reservoir 108 into the steam generator 112. The cleaning assembly 106 is fluidly coupled to the cleaning head 104 such that steam generated by the steam generator 112 is delivered to the cleaning head 104.

The cleaning head 104 includes a plurality of cleaning pads 114 configured to engage with a surface to be cleaned 116 and a pad motor 118 configured to cause each of the cleaning pads 114 to rotate. The cleaning pads 114 may be configured to co-rotate (the cleaning pads 114 each rotate in the same direction) or counter rotate (at least one cleaning pad 114 rotates in a direction different from at least one other cleaning pad 114).

A drivetrain 120 of the cleaning head 104 transfers rotational motion of a motor driveshaft 119 of the pad motor 118 to each of the cleaning pads 114 such that a rotation of the motor driveshaft 119 causes a corresponding rotation in each of the cleaning pads 114. In other words, the drivetrain 120 is configured to transfer rotational motion from the pad motor 118 to each of the cleaning pads 114. As such, a single pad motor 118 can cause both cleaning pads 114 to rotate. In some instances, the drivetrain 120 may generally be referred to as a reduction drivetrain. For example, the drivetrain 120 may be configured to have a 50:1 reduction ratio such that each cleaning pad 114 rotates 50 times slower than the motor driveshaft 119.

The steam delivered to the cleaning head 104 passes through each of the cleaning pads 114 and into contact with the surface to be cleaned 116. As such, the cleaning pads 114 may generally be described as being fluidly coupled to the cleaning assembly 106.

In some instances, the steam cleaning apparatus 100 may include a controller 122. For example, the controller 122 may be disposed within the cleaning assembly 106, the cleaning head 104, or the wand 102. The controller 122 may be configured to control and/or monitor the steam cleaning apparatus 100. For example, the controller 122 may be configured to receive one or more user inputs corresponding to a cleaning behavior (e.g., pad rotation speed, steam generation rate, and/or any other cleaning behavior). By way of further example, the controller 122 may be configured to monitor a status of the steam cleaning apparatus 100 (e.g., a temperature within the cleaning head, a stall condition of the pad motor 118, and/or any other status).

In some instances the controller 122 may be configured to control one or more features of the steam cleaning apparatus 100 based, at least in part, on a position of the wand 102 relative to the cleaning head 104. For example, when the wand 102 is in the storage position, the pump 110 may be disabled such that liquid is not delivered to the steam generator 112, the pad motor 118 may be disabled such that the cleaning pads 114 no longer rotate, and the steam generator 112 may continue to receive power. When the wand 102 is transitioned to the in-use position, the pump 110 is configured to deliver liquid to the steam generator 112 such that steam is generated and the pad motor 118 is configured to rotate the cleaning pads 114.

Figure 2:
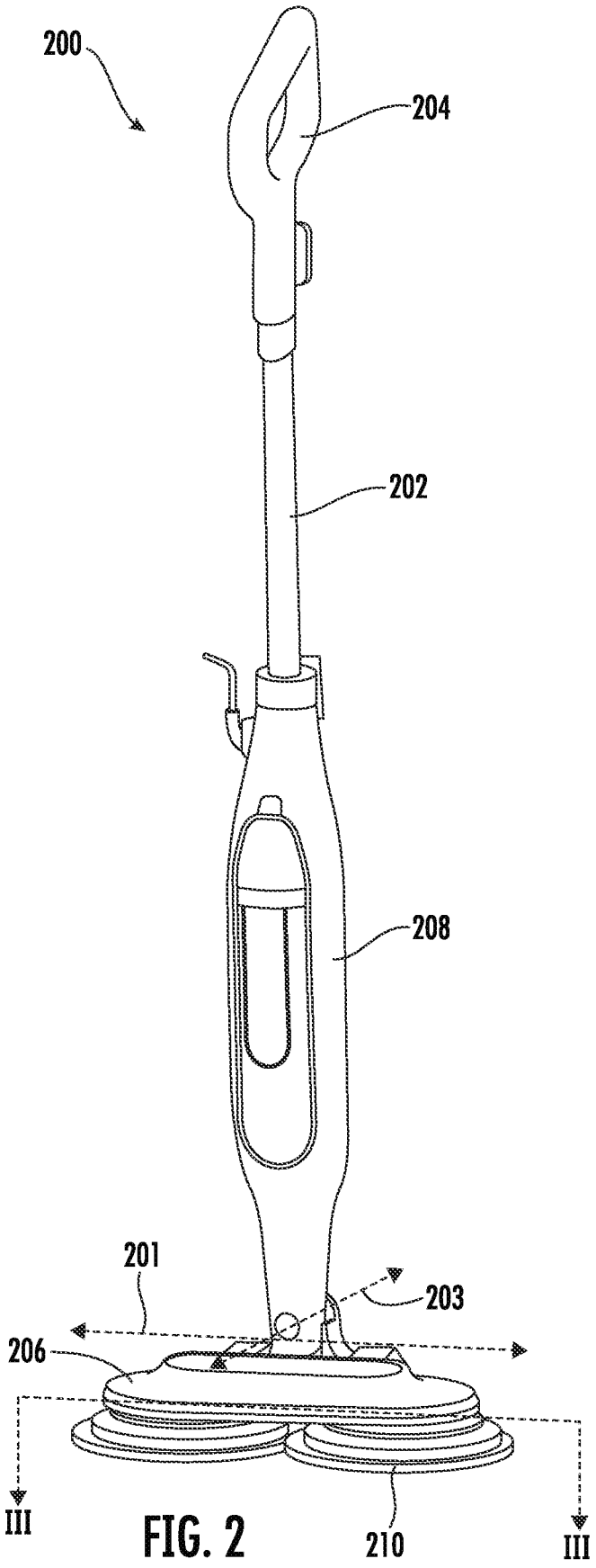
FIG. 2 shows a perspective view of a steam cleaning apparatus, consistent with embodiments of the present disclosure.

FIG. 2 shows a perspective view of an example of a steam cleaning apparatus 200, which may be an example of the steam cleaning apparatus 100 of FIG. 1. As shown, the steam cleaning apparatus 200 includes a wand 202 having a handle 204 pivotally coupled to a cleaning head 206. For example, the wand 202 may be configured to pivot about a first axis 201 between a storage and an in-use position and to pivot about a second axis 203 between a centered position and at least one side position. The first axis 201 may extend transverse (e.g., perpendicular) to a forward direction of movement and the second axis 203 may extend transverse (e.g., perpendicular) to the first axis 201.

A cleaning assembly 208 is coupled to the wand 202 and fluidly coupled to the cleaning head 206. The cleaning assembly 208 is configured to generate steam that flows into the cleaning head 206. As shown, the cleaning head 206 includes a plurality of cleaning pads 210 which are configured to rotate. In operation, steam is configured to pass through the cleaning pads 210.

Figure 3:
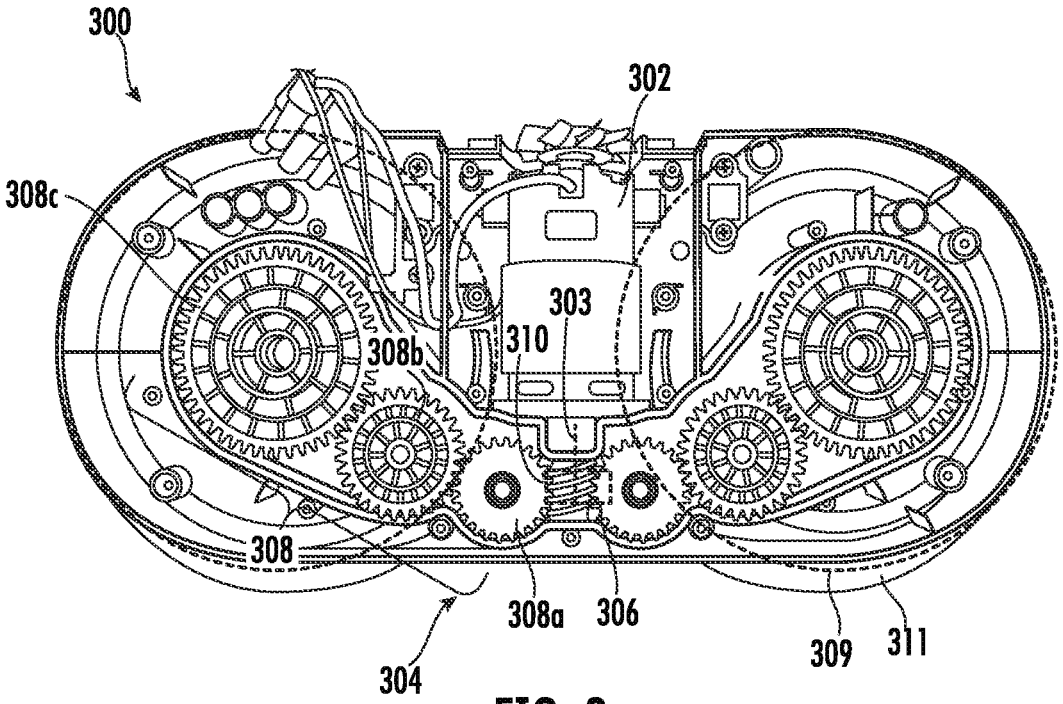
FIG. 3 shows a cross-sectional view of an example of a cleaning head of the steam cleaning apparatus of FIG. 2, consistent with embodiments of the present disclosure.

FIG. 3 shows a cross-sectional view of a cleaning head 300 which may be an example of a cross-section of the cleaning head 206 taken along the line III-III of FIG. 2. As shown, the cleaning head 300 includes a pad motor 302 and a drivetrain 304. The drivetrain 304 includes a worm 306 coupled to a motor driveshaft 303 (shown schematically in hidden lines) of the pad motor 302 and a plurality of gears 308. Rotation of the worm 306 causes a corresponding rotation in the plurality of gears 308. As shown, the plurality of gears 308 include a plurality of worm gears **308*a* configured to engage with the worm 306, a plurality of intermediary gears 308*b*, each configured to engage with a respective worm gear 308*a*, and a plurality of pad gears 308*c*, each configured to engage with a respective intermediary gear 308*b*. Each pad gear 308*c* is coupled to a corresponding pad holder 309 (shown schematically with hidden lines) such that the pad holder 309 rotates with the pad gear 308*c*. In some instances, the plurality of gears 308 can be configured such that the drivetrain 304 reduces a rotational speed of the cleaning pads 210 relative to the rotational speed of the worm 306**.

The pad holder 309 is configured to couple to the cleaning pad 210. In some instances, a pad skirt 311 may extend over at least a portion of the pad holder 309. The pad skirt 311 may be configured to mitigate or prevent wear on the pad holder 309 resulting from contact between the pad skirt 311 and the pad holder 309. For example, at least a portion of the pad skirt 311 may include one or more abrasion mitigating members configured to engage at least a portion of the pad holder 309, wherein the abrasion mitigating members are configured to reduce wear on the pad holder 309. The one or more abrasion mitigating members may extend along an inner portion of the pad skirt 311. The one or more abrasion mitigating members may be complaint material (e.g., a rubber) and/or a low friction material (e.g., polytetrafluoroethylene).

Rotation of the worm 306 and the plurality of gears 308 may result in a temperature rise within the cleaning head 300. Rising temperatures may result in one or more of the plurality of gears 308 failing (e.g., no longer performing as intended). For example, if the plurality of gears 308 are made of a temperature sensitive material (e.g., a plastic), one or more of the plurality of gears 308 may fail when the temperature exceeds a threshold. As such, one or more temperature sensors 310 (shown schematically) may be positioned proximate the drivetrain 304 and be configured to measure a temperature of the drivetrain 304. For example, one or more temperature sensors 310 may be positioned proximate to one or more of the plurality of gears 308 (e.g., proximate to the worm gear 308*a*) and/or the worm 306. As shown, at least one of the one or more temperature sensors 310 may be positioned above or below the worm 306 (e.g., directly above or below the worm 306 such that a central axis of the temperature sensor 310 is aligned with a central axis of the worm 306). In response to the one or more temperature sensors 310 sensing a temperature that exceeds a predetermined high temperature threshold, the pad motor 302 may be disabled. The predetermined high temperature threshold may be in a range of, for example, 100 degrees Celsius (° C.) and 110° C. By way of further example, the predetermined high temperature threshold may be 105° C. The pad motor 302 may be disabled for a predetermined time and/or until the temperature sensed by the one or more temperature sensors 310 drops below a predetermined operational temperature threshold.

In some instances, the pad motor 302 may include a planetary gear train that is configured to reduce a rotational speed of the motor driveshaft 303 of the pad motor 302. Such a configuration may mitigate temperature rise caused by rotation of the gears. As such, in these instances, the temperature sensors 310 may be omitted.

Figure 4:
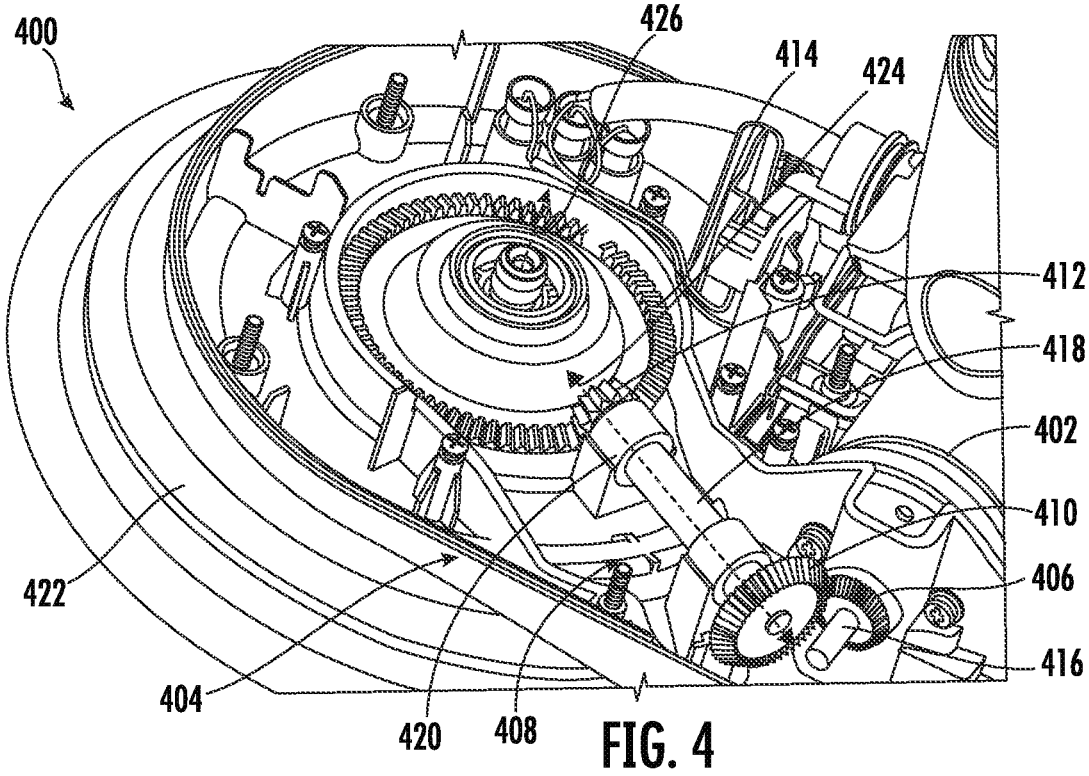
FIG. 4 shows a cross-sectional perspective view of a portion of another example of a cleaning head of the steam cleaning apparatus of FIG. 2, consistent with embodiments of the present disclosure.

FIG. 4 shows a cross-sectional perspective view of a portion of a cleaning head 400, which may be an example of a cross-section of the cleaning head 206 along the line III-III of FIG. 2. As shown, the cleaning head 400 includes a pad motor 402 and a drivetrain 404. The drivetrain 404 includes a drive bevel gear 406, a plurality of step-down bevel assemblies 408, each having a first and second step-down bevel gear 410 and 412, and a plurality pad bevel gears 414. The drive bevel gear 406 is coupled to a motor driveshaft 416 of the pad motor 402 such that the drive bevel gear 406 rotates together with the motor driveshaft 416.

As shown, the first step-down bevel gear 410 and the second step-down bevel gear 412 are each coupled to a gear driveshaft 418 (e.g., at opposing ends of the gear driveshaft 418). The gear driveshaft 418 is supported by one or more bearings 420 (e.g., thrust bearings) such that the gear driveshaft 418 rotates. The first step-down bevel gear 410 engages the drive bevel gear 406 such that rotation of the drive bevel gear 406 causes a corresponding rotation of the first step-down bevel gear 410. Rotation of the first step-down bevel gear 410 causes a corresponding rotation in the gear driveshaft 418. Rotation of the gear driveshaft 418 causes a corresponding rotation of the second step-down bevel gear 412. The second step-down bevel gear 412 engages the pad bevel gear 414 such that a rotation of the second step-down bevel gear 412 causes a corresponding rotation in the pad bevel gear 414. The pad bevel gear 414 is coupled to a corresponding pad holder 422 such that a rotation of the pad bevel gear 414 causes a corresponding rotation of the pad holder 422. The pad holder 422 is configured to couple to the cleaning pad 210.

As shown, a driveshaft longitudinal axis 424 extends transverse (e.g., perpendicular) to a pad rotation axis 426. For example, the pad rotation axis 426 may be a vertical axis and the driveshaft longitudinal axis 424 may be a horizontal axis.

Use of bevel gears may mitigate temperature rise caused by rotation of the gears when compared to, for example, the drivetrain 304 of FIG. 3. As such, in these instances, temperature sensors to monitor a temperature of the drivetrain 404 may be omitted.

Figure 5:
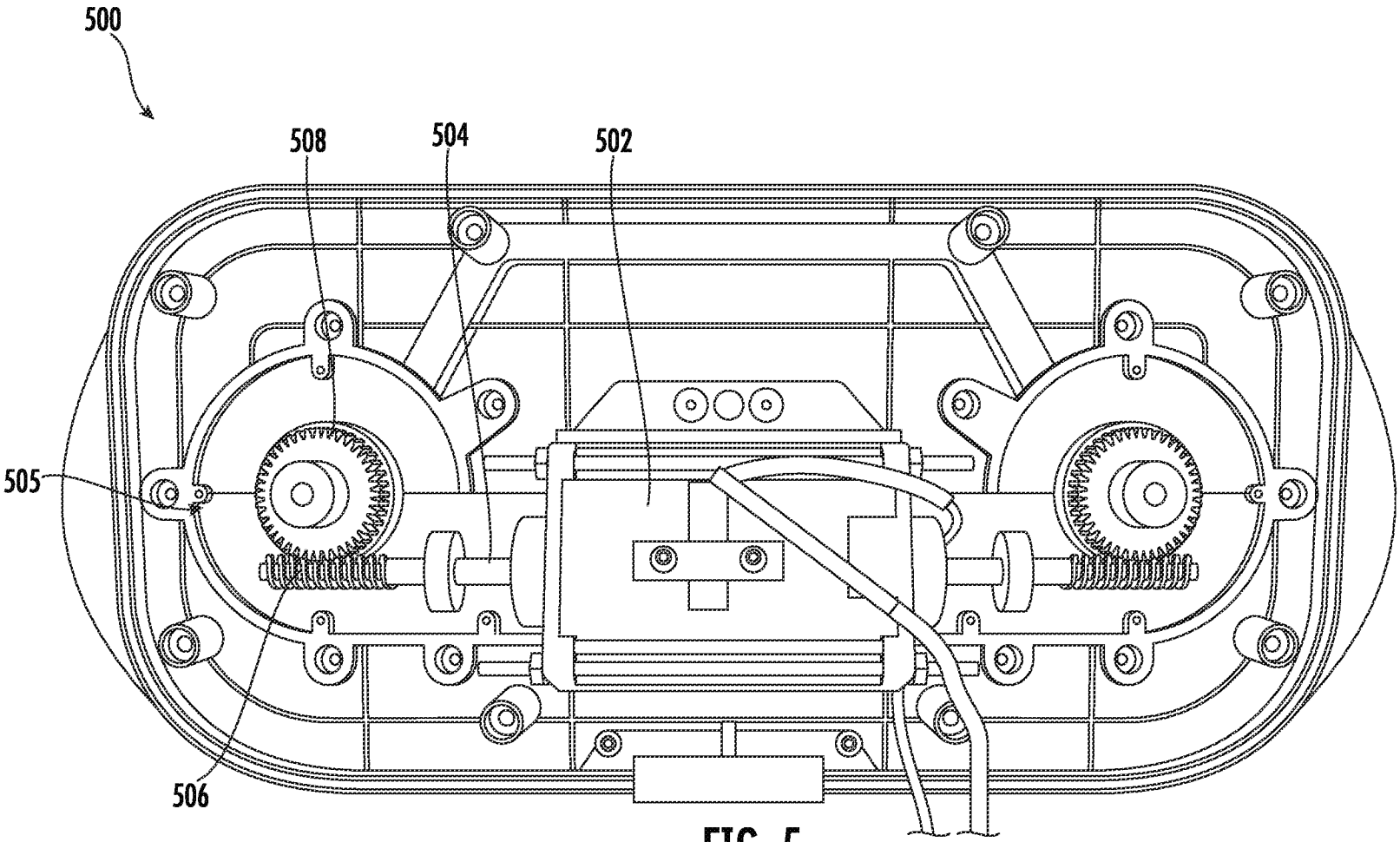
FIG. 5 shows a cross-sectional view of another example of a cleaning head of the steam cleaning apparatus of FIG. 2, consistent with embodiments of the present disclosure.

FIG. 5 shows a cross-sectional view of a cleaning head 500 which may be an example of a cross-section of the cleaning head 206 along the line III-III of FIG. 2. As shown, the cleaning head 500 includes a pad motor 502. As shown, the pad motor 502 includes a plurality of motor driveshafts 504, each motor driveshaft 504 extending from an opposing end of the pad motor 502 and configured to engage with a drivetrain 505. The drivetrain 505 includes a plurality of worms 506 and a plurality of worm gears 508, each worm 506 is coupled to a respective motor driveshaft 504. Each worm 506 is configured to engage with a corresponding worm gear 508. Each worm gear 508 is configured to cause a corresponding pad holder to rotate, wherein each pad holder is configured to couple to a respective cleaning pad 210.

Figure 6:
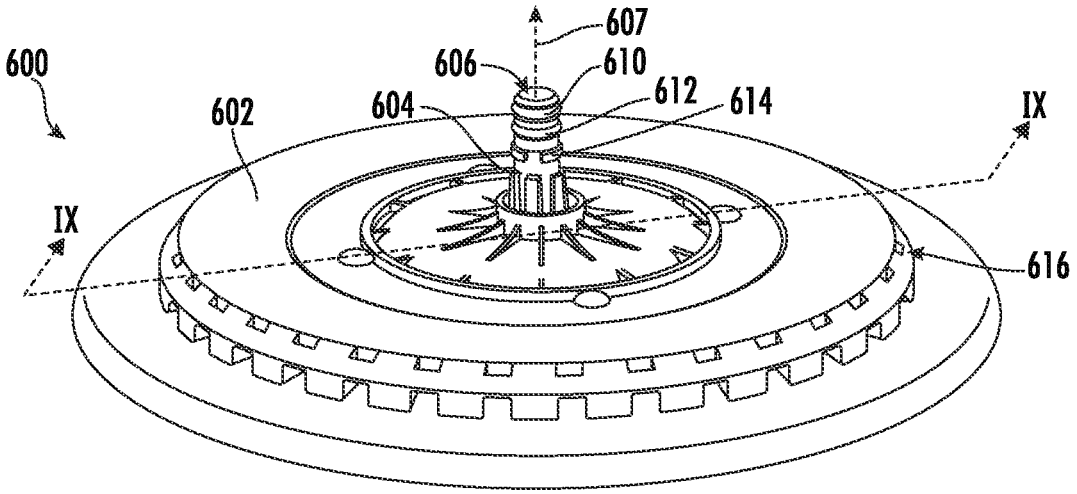
FIG. 6 shows a perspective top view of an example of a pad holder of the steam cleaning apparatus of FIG. 2, consistent with embodiments of the present disclosure.
Figure 7:
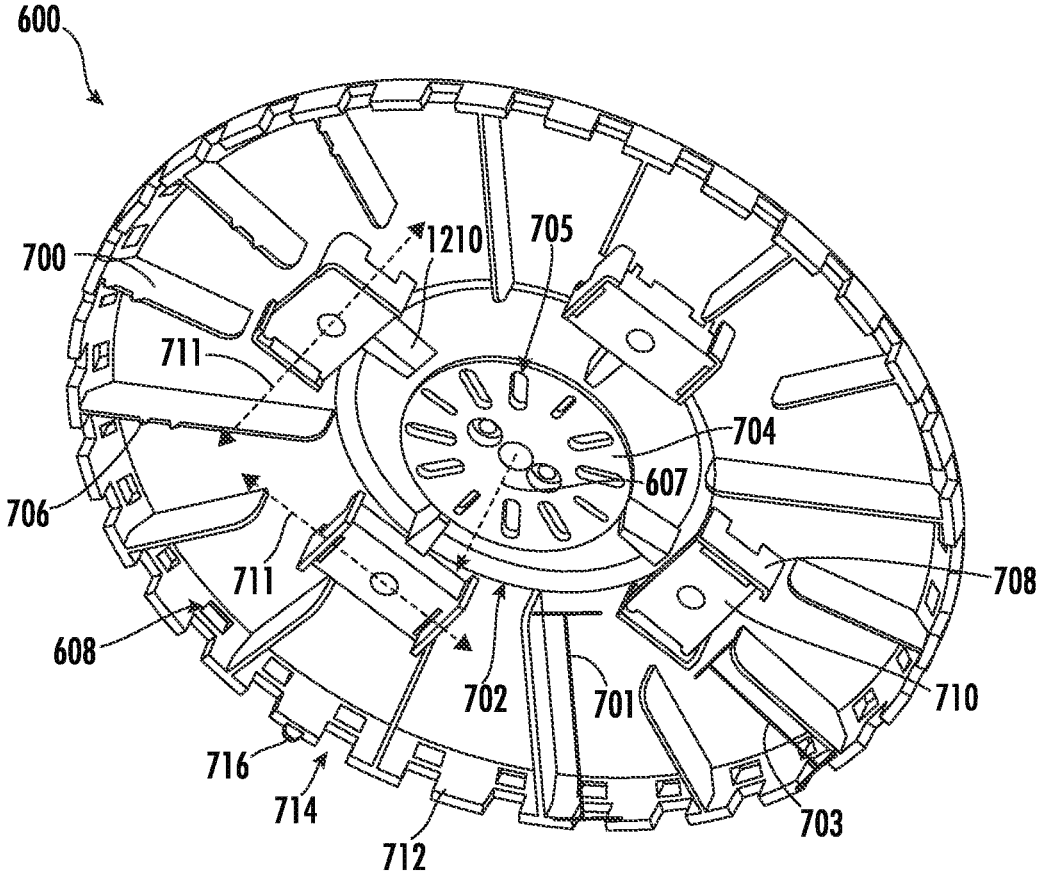
FIG. 7 shows a perspective bottom view of the pad holder of FIG. 6, consistent with embodiments of the present disclosure.

FIGS. 6 and 7 show a perspective view of a pad holder 600 coupled to the cleaning pad 210 of FIG. 2. The pad holder 600 is configured to be rotationally coupled to the cleaning head 206 of FIG. 2. As shown, the pad holder 600 includes a holder body 602, a pad driveshaft 604 defining a steam channel 606 therein, and a steam distribution cavity 608 fluidly coupled to the steam channel 606. The pad driveshaft 604 defines a pad rotation axis 607 that extends transverse to (e.g., perpendicular to) a surface to be cleaned.

Figure 8A:
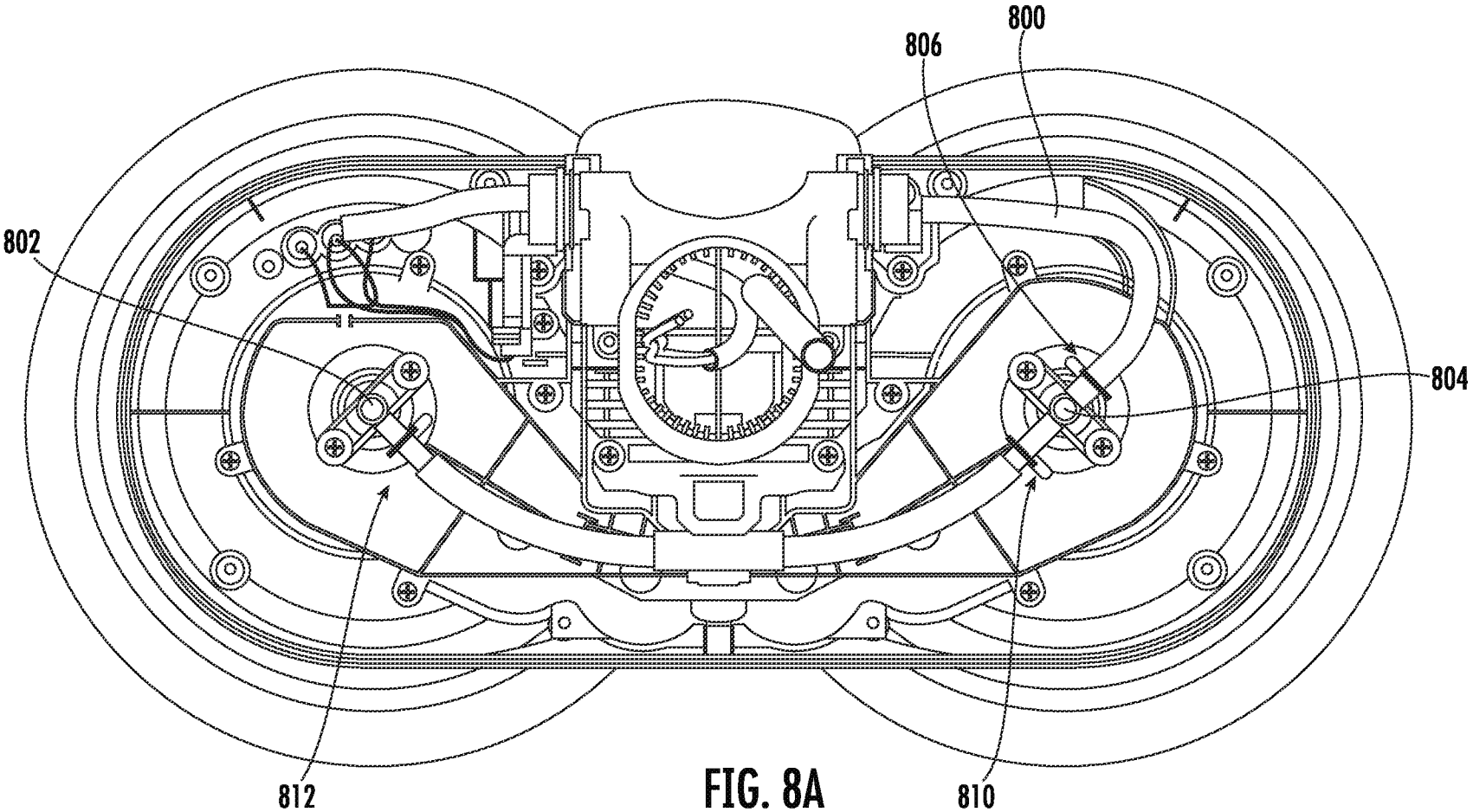
FIG. 8A shows a top view an example of a cleaning head of the steam cleaning apparatus of FIG. 2 having a portion a top of the housing removed for purposes of clarity, consistent with embodiments of the present disclosure.
Figure 8B:
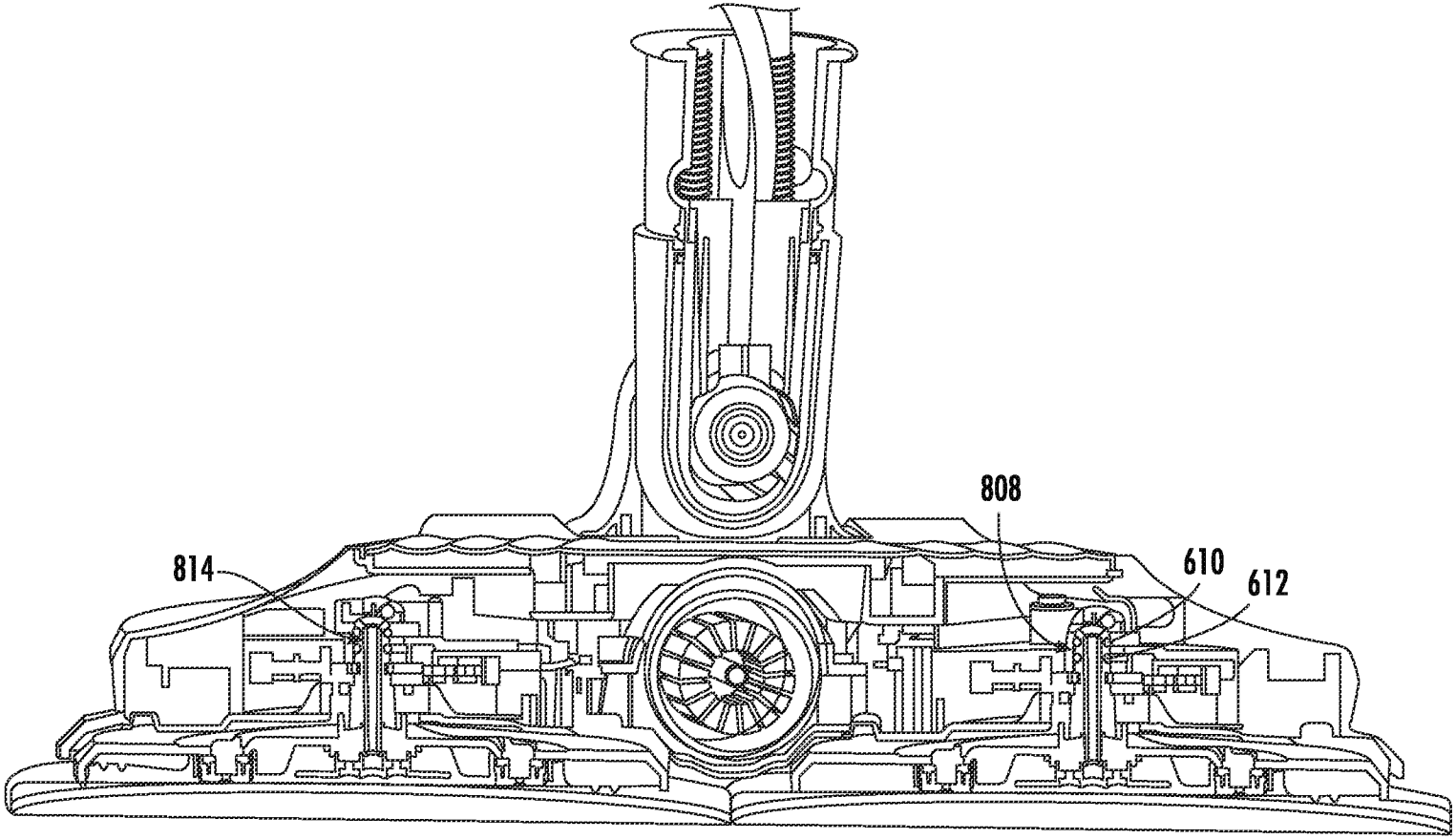
FIG. 8B shows a cross-sectional perspective view of an example of the cleaning head of FIG. 8A, consistent with embodiments of the present disclosure.
Figure 19:
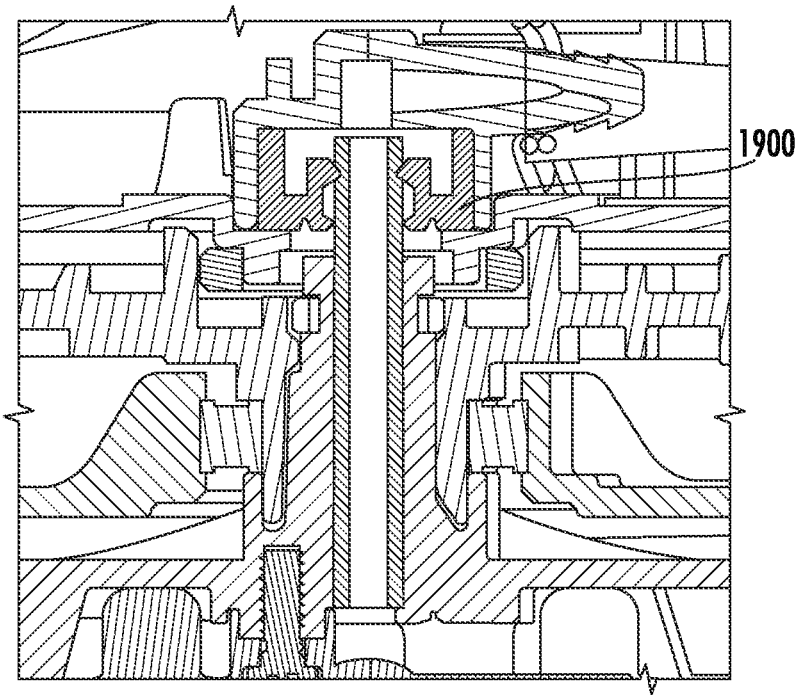
FIG. 19 shows a cross-sectional view of a portion of a cleaning head having an oil seal, consistent with embodiments of the present disclosure.

The steam channel 606 is fluidly coupled to the cleaning assembly 208 such that steam generated by the cleaning assembly 208 passes through the steam channel 606 and into the steam distribution cavity 608. The pad driveshaft 604 is configured to couple to a drivetrain of the cleaning head 206 (e.g., the drivetrain 304, 404, or 505) such that the pad holder 600 rotates. As shown, the pad driveshaft further includes a first seal 610, a second seal 612, and a coupling 614. The coupling 614 is configured to couple the pad holder 600 to the drivetrain of the cleaning head 206 (e.g., couples the pad holder 600 to pad gear 308*c*, pad bevel gear 414, or worm gear 508) such that the pad holder 600 rotates. One example of the coupling 614 may be a C-clip. The seals 610 and 612 are configured to sealingly engage with a steam distribution line 800 (see, FIG. 8A) such that the seals 610 and 612 rotate relative to an inner surface of the steam distribution line. For example, with reference to FIG. 8A, the steam distribution line 800 includes a terminal steam connector 802 and an intermediary steam connector 804. The intermediary steam connector 804 has an intermediary steam inlet 806, a first intermediary steam outlet 808 (see, FIG. 8B) configured to sealingly engage with the seals 610 and 612 of a respective pad driveshaft 604, and a second intermediary steam outlet 810 fluidly coupled to the terminal steam connector 802. The terminal steam connector 802 includes a terminal steam inlet 812 fluidly coupled to the second intermediary steam outlet 810 of the intermediary connector 804 and a terminal steam outlet 814 (see, FIG. 8B) configured to sealingly engage with the seals 610 and 612 of a respective pad driveshaft 604. When the seals 610 and 612 are sealingly engaged with the distribution line 800 some steam may escape past the seals 610 and 612. The seals 610 and 612 may be, for example, O-ring seals. In some instances, the seals 610 and 612 may be replaced with an oil seal 1900 (see, FIG. 19). The oil seal 1900 may have increased longevity when compared to O-ring seals.

Turning back to FIGS. 6 and 7, the pad holder 600 may further include one or more holder steam outlets 616. The one or more holder steam outlets 616 are fluidly coupled to the steam distribution cavity 608 such that steam received by the steam distribution cavity 608 may pass through the one or more holder steam outlets 616. The one or more holder steam outlets 616 may be configured to divert steam passing therethrough such that the diverted steam does not pass through corresponding cleaning pads 210 (e.g., in a direction away from the cleaning pad 210). Such a configuration may provide a visual confirmation that steam is being generated.

With reference to FIG. 7, the steam distribution cavity 608 may include a plurality of ribs 700 extending within the steam distribution cavity 608, a pad mount receptacle 702, and a steam diffusion plate 704 configured to diffuse steam passing out of the steam channel 606. In some instances, the steam diffusion plate 704 may include one or more plate passthroughs 705 through which steam can pass.

As shown, the plurality of ribs 700 extend in a direction that is radially outward from the pad rotation axis 607. The plurality of ribs 700 are configured to engage (e.g., contact) the cleaning pad 210 such that the ribs 700 support the cleaning pad 210, encouraging an even force distribution when the cleaning pad 210 engages a surface to be cleaned. The plurality of ribs 700 may include one or more ribs 700 having a first rib length 701 and one or more ribs having a second rib length 703, the first rib length 701 being greater than the second rib length 703. The first and second rib lengths 701 and 703 extend in a direction that is radially outward from the pad rotation axis 607. In some instances, for example, a ratio of a number of ribs 700 having the first rib length 701 to a number of ribs 700 having the second rib length 703 (i.e., a number of ribs 700 having the first rib length 701 divided by a number of ribs having the second rib length 703) may be 1:3.

In some instances, one or more of the plurality of ribs 700 may include one or more rib protrusions 706 configured to engage (e.g., extend into) the cleaning pad 210 such that movement (e.g., rotational movement) of the cleaning pad 210 relative to the pad holder 600 is resisted by the rib protrusions 706. For example, and as shown, each rib 700 may include a plurality of rib protrusions 706, forming a set, wherein a set of rib protrusions 706 corresponding to a first rib 700 are radially offset relative to sets of rib protrusions 706 corresponding to immediately adjacent ribs 700. In other words, a first plurality of rib protrusions 706 corresponding to a first rib 700 is radially offset from a second plurality of rib protrusions 706 corresponding to immediately adjacent ribs 700. By way of further example, a set of rib protrusions 706 corresponding to a first rib 700 may be radially offset relative to sets of rib protrusions 706 corresponding to immediately adjacent ribs 700 such that only a portion of the set of rib protrusions 706 corresponding to the first rib 700 overlaps with only a portion of at least one of the sets of rib protrusions 706 corresponding to immediately adjacent ribs 700. By way of still further example, a set of rib protrusions 706 corresponding to a first rib 700 may be radially offset relative to sets of rib protrusions 706 corresponding to immediately adjacent ribs 700 such that the set of rib protrusions 706 corresponding to the first rib 700 does not overlap with the sets of rib protrusions 706 corresponding to immediately adjacent ribs 700. By way of still further example, a set of rib protrusions 706 corresponding to a first rib 700 are not radially offset relative to sets of rib protrusions 706 corresponding to immediately adjacent ribs 700.

Figure 8C:
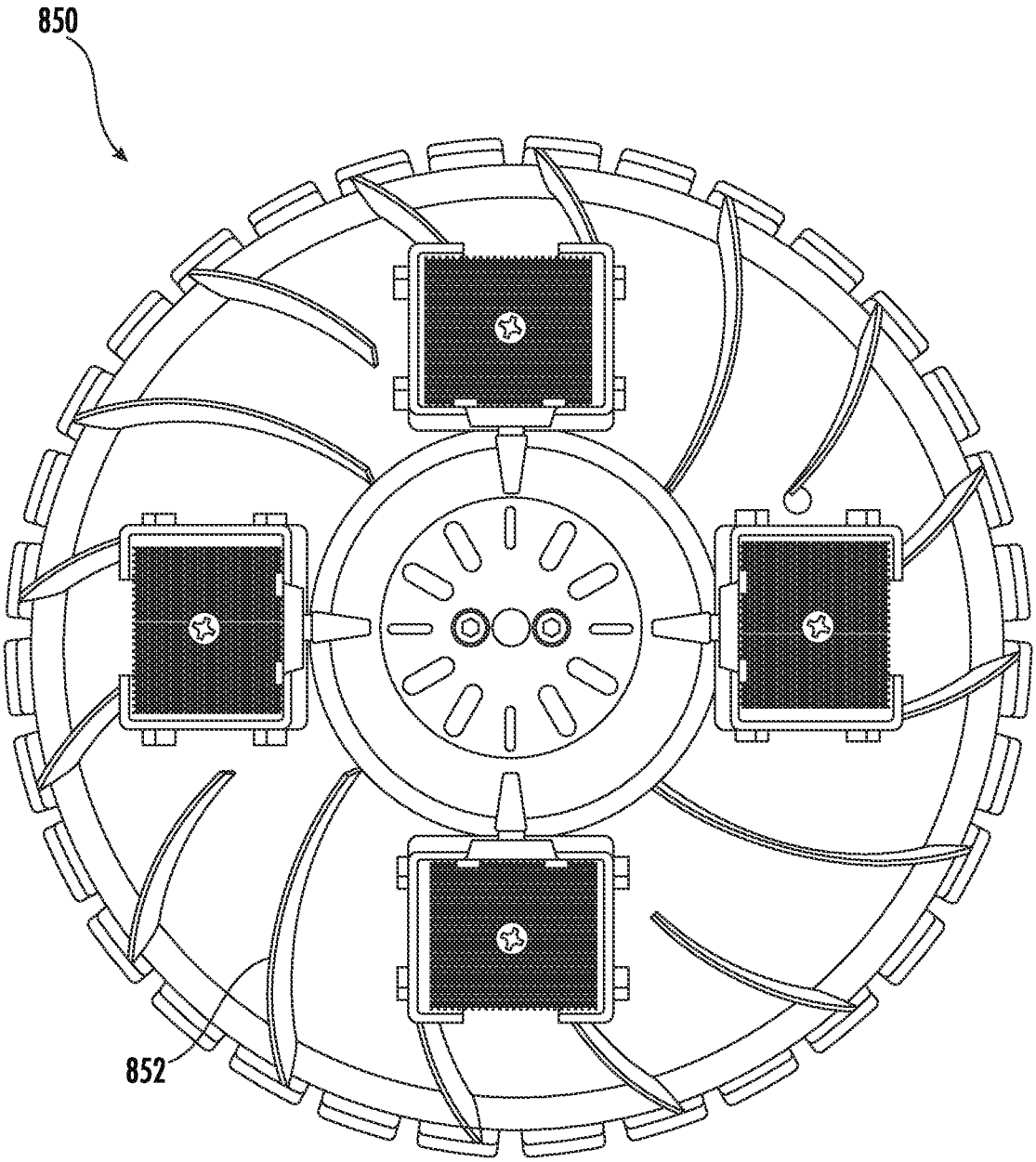
FIG. 8C shows a bottom view of another example of a pad holder of the steam cleaning apparatus of FIG. 2, consistent with embodiments of the present disclosure.

The ribs 700 may further encourage the distribution of steam within the steam distribution cavity 608. For example, and as shown, adjacent ribs 700 define steam channels that extend radially outward from the pad rotation axis 607. Steam flowing between adjacent ribs 700 may be encouraged to flow to a perimeter of the steam distribution cavity 608, encouraging an even distribution of steam within the steam distribution cavity 608. In some instances, and as shown, the plurality of ribs 700 may be linear. However, the plurality of ribs 700 may have any shape including, for example, an arcuate shape. For example, FIG. 8C shows a pad holder 850 having arcuate ribs 852. The arcuate ribs 852 may be curved to correspond to a direction of motion (e.g., such that a convex surface of the arcuate ribs faces the rotation direction or such that a concave surface of the arcuate ribs faces the rotation direction).

As also shown, the steam distribution cavity 608 includes one or more fastener receptacles 708, each configured to receive a corresponding one or more pad fasteners 710. The pad fasteners 710 are configured to removably couple the cleaning pad 210 to the pad holder 600. The pad fasteners 710 are further configured such that movement (e.g., rotational movement) of the cleaning pad 210 relative to the pad holder 600 is resisted by the pad fasteners 710. The pad fasteners 710 may form a part of a hook and loop fastener, wherein the pad fasteners 710 are one of the hook or the loop and the cleaning pad 210 forms the other one of the hook or the loop. The orientation of the hook and loop fastener may be configured to increase a shear resistance of the connection. For example, the pad fasteners 710 may be oriented such that fastener axes (e.g., longitudinal axes) 711 of at least two immediately adjacent pad fasteners 710 extend in a direction transverse to each other (e.g., at a perpendicular or non-perpendicular angle). Each fastener axis 711 may extend parallel to opposing sides of a respective pad fastener 710. By way of further example, the pad fasteners 710 maybe oriented such that the hooks and/or loops of a hook and loop fastener form a substantially (e.g., within 1°, 2°, 3°, or 4° of) 0°, 45°, or 90° angle with a radial line that extends from the pad rotation axis 607 and intersects the respective hook or loop. Additionally, or alternatively, the hooks and/or loops may be oriented on the pad fastener such that the hooks and/or loops form a substantially 0°, 45°, or 90° angle with a radial line that extends from the pad rotation axis 607 and intersects the respective hook or loop. By way of still further example, the hooks and/or loops may be arranged in a plurality of parallel rows, wherein the hooks and/or loops of a central most row form a substantially 0°, 45°, or 90° with a radial line that extends from the pad rotation axis 607 and intersects each hook and/or loop of the central most row.

The pad fasteners 710 may be, for example, an adhesive tape hook or loop fastener and/or a molded hook or loop fastener. At least a portion of the pad fasteners 710 may be made of, for example, nylon.

The pad holder 600 may further include a plurality of castellations 712 defined in the holder body 602 and positioned along a perimeter of the steam distribution cavity 608. The castellations 712 may be evenly spaced about the perimeter of the steam distribution cavity 608. The openings 714 extending between adjacent castellations 712 are fluidly coupled to the steam distribution cavity 608, allowing steam to pass therethrough. In some instances, the ribs 700 may encourage steam to pass through the openings 714. One or more of the castellations 712 may include one or more castellation protrusions 716. The one or more castellation protrusions 716 are configured to engage (e.g., extend into) the cleaning pad 210 such that movement (e.g., rotational movement) of the cleaning pad relative to the pad holder 600 is resisted by the castellation protrusions 716. In some instances, for example, there may be at least four castellation protrusions 716, wherein the castellation protrusions 716 are evenly spaced about a perimeter of the steam distribution cavity 608.

Figure 9:
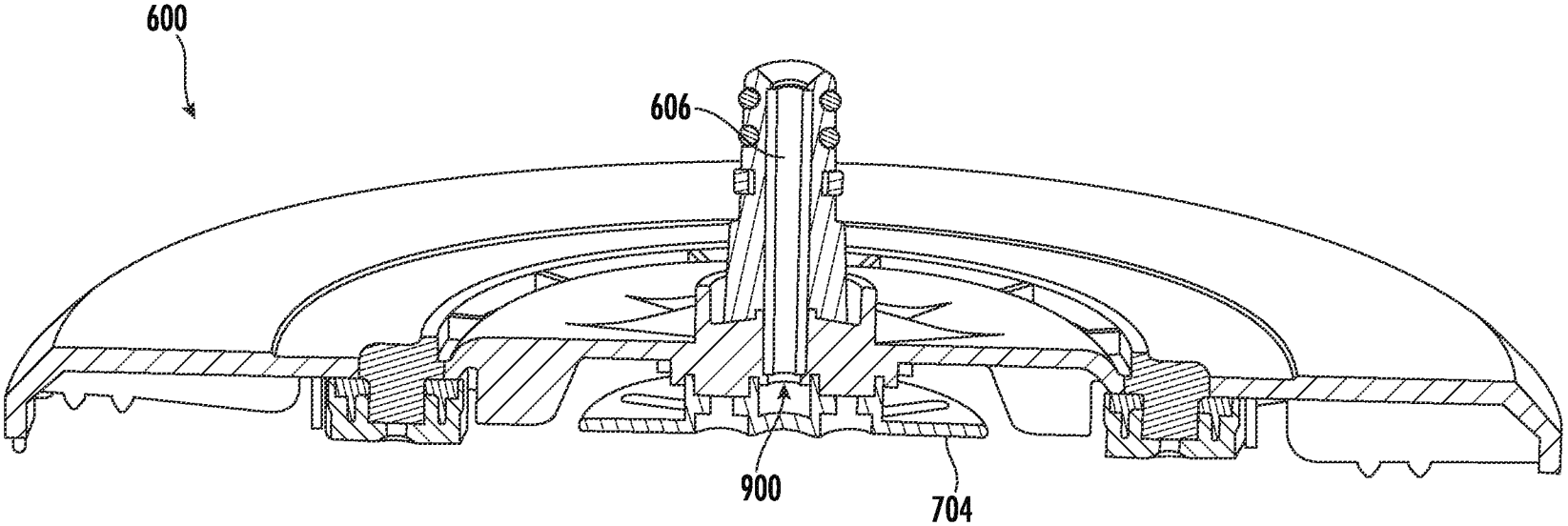
FIG. 9 shows a cross-sectional perspective view of the pad holder of FIG. 6, consistent with embodiments of the present disclosure.

FIG. 9 shows a cross-sectional perspective view of the pad holder 600 taken along the line IX-IX of FIG. 6. As shown, the steam diffusion plate 704 is proximate a steam outlet 900 of the steam channel 606 such that at least a portion of the steam passing through the steam outlet 900 is incident of the steam diffusion plate 704.

Figure 10:
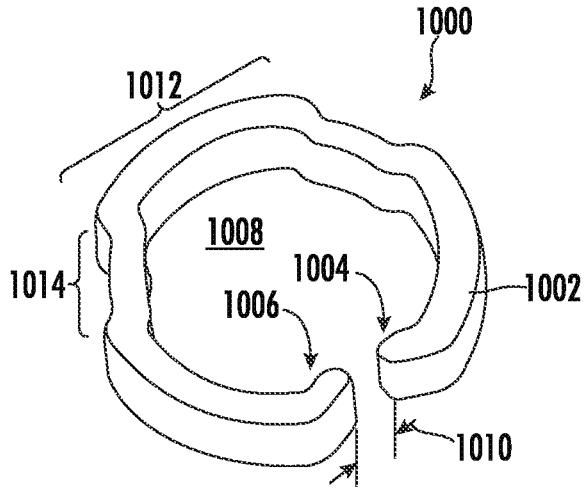
FIG. 10 shows a perspective view of an example of a coupling for coupling a pad holder to the steam cleaning apparatus of FIG. 2, consistent with embodiments of the present disclosure.

FIG. 10 shows a perspective view of an example of a coupling 1000 that is configured to couple the pad holder 600 to the drivetrain of the cleaning head 206 (e.g., couples the pad holder 600 to pad gear 308*c*, pad bevel gear 414, or worm gear 508). The coupling 1000 may be an example of the coupling 614 of FIG. 6.

As shown, the coupling 1000 includes a coupling body 1002 having a first end 1004 and a second end 1006 that partially encloses an area 1008 configured for receiving a portion of the pad driveshaft 604. The first and second ends 1004 and 1006 are spaced apart from each other by a separation distance 1010 such that the coupling body 1002 partially encloses the area 1008. As shown, the coupling body 1002 defines a plurality of arcuate regions 1012, wherein immediately adjacent arcuate regions 1012 are each separated by a recessed region 1014. The recessed region 1014 may be a non-arcuate region (e.g., a planar region). The coupling body 1002 may be formed of glass filled nylon (e.g., nylon having a 15% glass fill).

Figure 11:
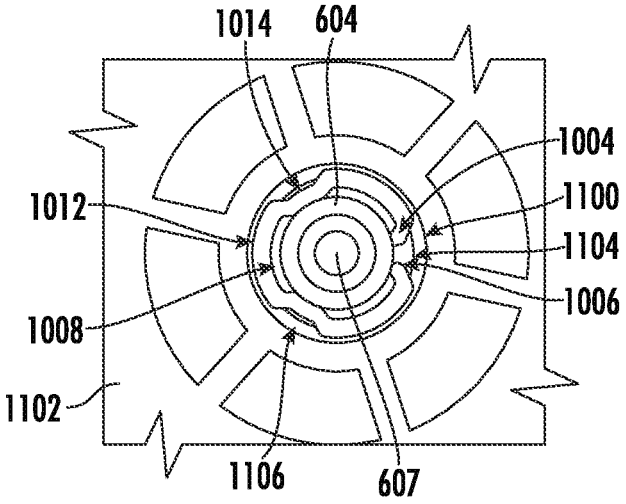
FIG. 11 shows a top view of the coupling of FIG. 10 coupling the pad holder to the steam cleaning apparatus of FIG. 2, consistent with embodiments of the present disclosure.

As shown in FIG. 11, the arcuate regions 1012 engage with corresponding arcuate regions 1100 defined by a gear 1102 of the drivetrain of the cleaning head 206. The arcuate regions 1100 defined by the gear 1102 may define at least a portion of a receptacle 1104 for receiving the coupling 1000. As shown, the receptacle 1104 may include a base 1106 configured to support the coupling 1000.

As also shown, the coupling body 1002 extends around the pad rotation axis 607. The coupling body 1002 can be configured to engage (e.g., contact) the pad driveshaft 604. For example, the coupling body 1002 can contact the pad driveshaft 604 at the recessed regions 1014 and at the first and second ends 1004 and 1006 and the coupling body 1002 can be spaced apart from the pad driveshaft 604 at the arcuate regions 1012. As such, the coupling 1000 may generally be described as having at least four points of contact with the pad driveshaft 604. Engagement between the pad driveshaft 604 and the coupling body 1002 may align the coupling body 1002 relative to the pad driveshaft 604 such that, for example, the pad rotation axis 607 extends centrally through the area 1008 partially enclosed by the coupling body 1002. In some instances, engagement between the pad driveshaft 604 and the coupling body 1002 may result in improved retention of the pad driveshaft 604 (e.g., when compared to a C-clip).

Figure 12:
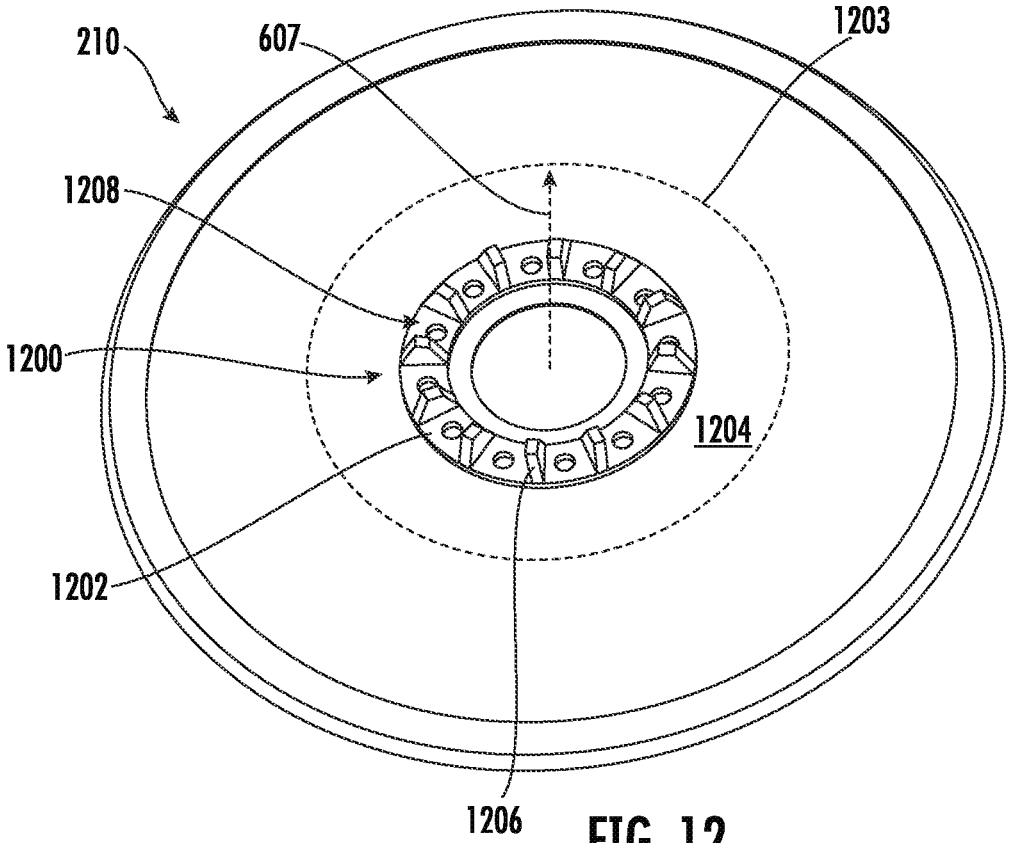
FIG. 12 shows a perspective top view of a cleaning pad of the steam cleaning apparatus of FIG. 2, consistent with embodiments of the present disclosure.

FIG. 12 shows a perspective view of the cleaning pad 210. As shown, the cleaning pad 210 includes a pad mount 1200 configured to cooperate with the pad mount receptacle 702. The pad mount receptacle 702 may define a recessed region configured to receive at least a portion of the pad mount 1200. The pad mount 1200 may include a base 1202 (e.g., an annular base) that extends around (e.g., centrally around) the pad rotation axis 607. The annular base 1202 is coupled to a mounting surface 1204 of the cleaning pad 210. For example, the annular base 1202 may be coupled to the mounting surface 1204 using any one or more of an adhesive, stitching, and/or any other form of coupling. At least a portion of the mounting surface 1204 may form part of a hook and loop fastener. For example, the mounting surface 1204 may include an annular fastener region 1203 extending around the annular base 1202. The annular fastener region 1203 may form part of a hook and loop fastener.

The pad mount 1200 may further include one or more mount protrusions 1206 that extend from the annular base 1202. For example, a plurality of mount protrusions 1206 may extend along the annular base 1202 and may be spaced apart from each other in regular intervals. In this example, one or more of the mount spaces 1208 defined between immediately adjacent mount protrusions 1206 may be configured to receive a receptacle protrusion 1210 (see, FIG. 7) extending within the pad mount receptacle 702. As such, the pad mount 1200 may be configured to resist movement (e.g., rotational movement) of the cleaning pad 210 relative to the pad holder 600. As shown, there may be fewer receptacle protrusions 1210 than mount spaces 1208 defined between immediately adjacent mount protrusions 1206, such a configuration may encourage easier alignment of the pad mount 1200 with the pad mount receptacle 702.

As shown, the one or more mount protrusions 1206 may have a generally triangular shape with an arcuate (or rounded) vertex. However, the one or more mount protrusions 1206 may have other shapes (e.g., cylindrical, rectangular, or any other shape). The one or more mount protrusions 1206 may be configured to encourage alignment of the cleaning pad 210 with the pad holder 600.

Figure 13:
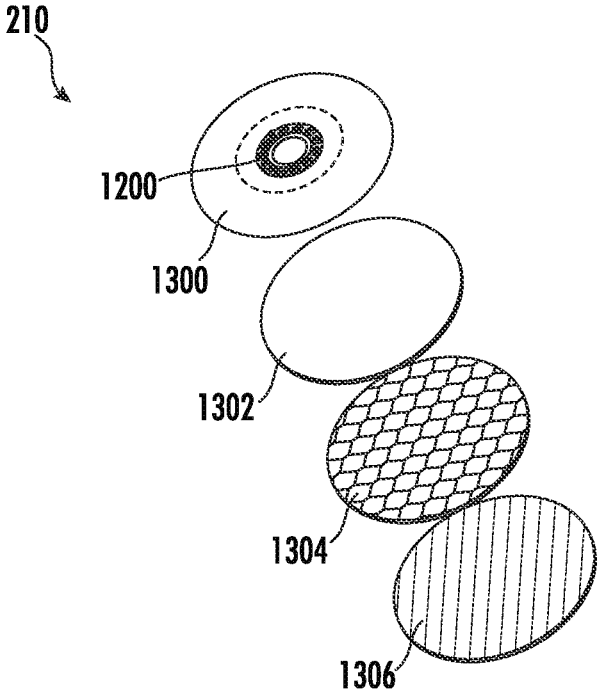
FIG. 13 shows an exploded view of the cleaning pad of FIG. 12, consistent with embodiments of the present disclosure.

FIG. 13 shows an exploded view of the cleaning pad 210. As shown, the cleaning pad 210 includes a plurality of layers. For example, the cleaning pad 210 may include a mounting layer 1300, a stiffening layer 1302, a netting layer 1304, and a cleaning layer 1306. The pad mount 1200 is coupled to the mounting layer 1300 and the mounting layer 1300 may include a material configured to couple to the pad fasteners 710. For example, the mounting layer 1300 may include a material that forms a hook or loop portion of a hook and loop fastener. The stiffening layer 1302 may be configured to stiffen the cleaning pad 210. Stiffening the cleaning pad 210 may mitigate a wrinkling of the cleaning pad 210 when rotated against a surface to be cleaned. The stiffening layer 1302 may be formed of a polyethylene mesh material (although other materials may be used). The netting layer 1304 may be a mesh material having a pore size that is greater than the pore size of the mesh material forming the stiffening layer 1302. The cleaning layer 1306 is configured to engage a surface to be cleaned. The cleaning layer 1306 may be, for example, a microfiber material (e.g., including polyester, olefin, and/or nylon). As shown, the stiffening layer 1302 is disposed between the netting layer 1304 and the mounting layer 1300 and the netting layer is disposed between the stiffening layer 1302 and the cleaning layer 1306. As such, the stiffening layer 1302 and the netting layer 1304 may generally be described as being internal layers. In operation, steam is capable of passing through each of the mounting layer 1300, the stiffening layer 1302, the netting layer 1304, and the cleaning layer 1306.

Figure 14:
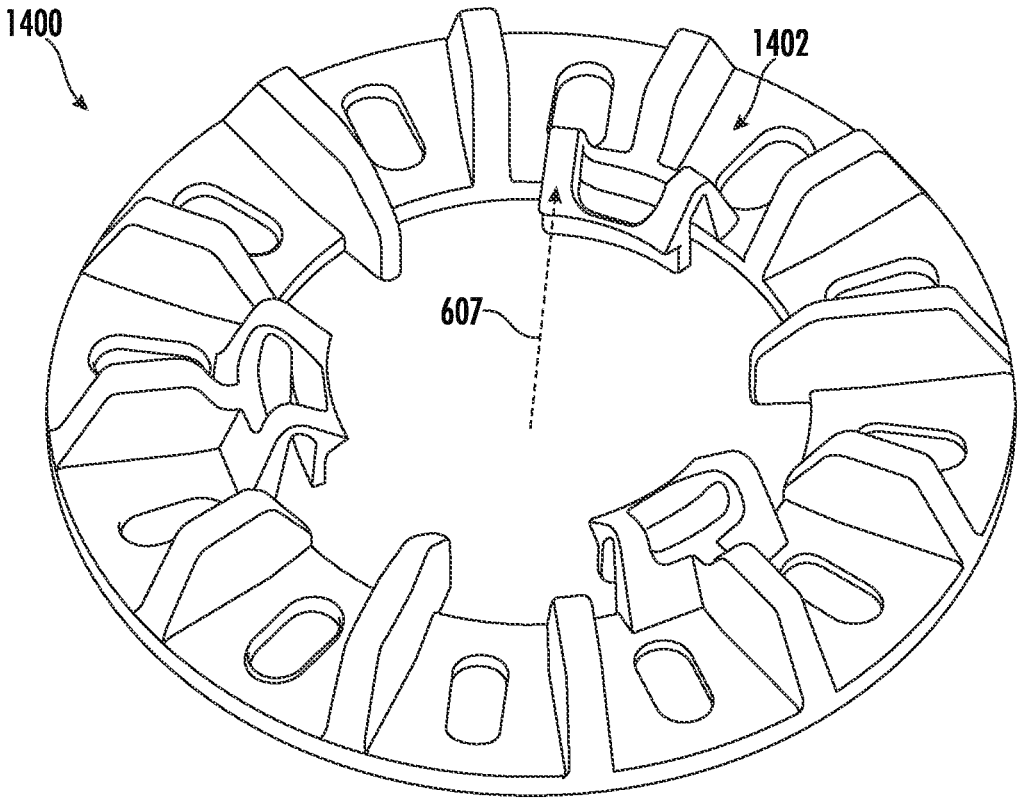
FIG. 14 shows a perspective view of an example of a pad mount configured to be used with the cleaning pad of FIG. 2, consistent with embodiments of the present disclosure.
Figure 15:
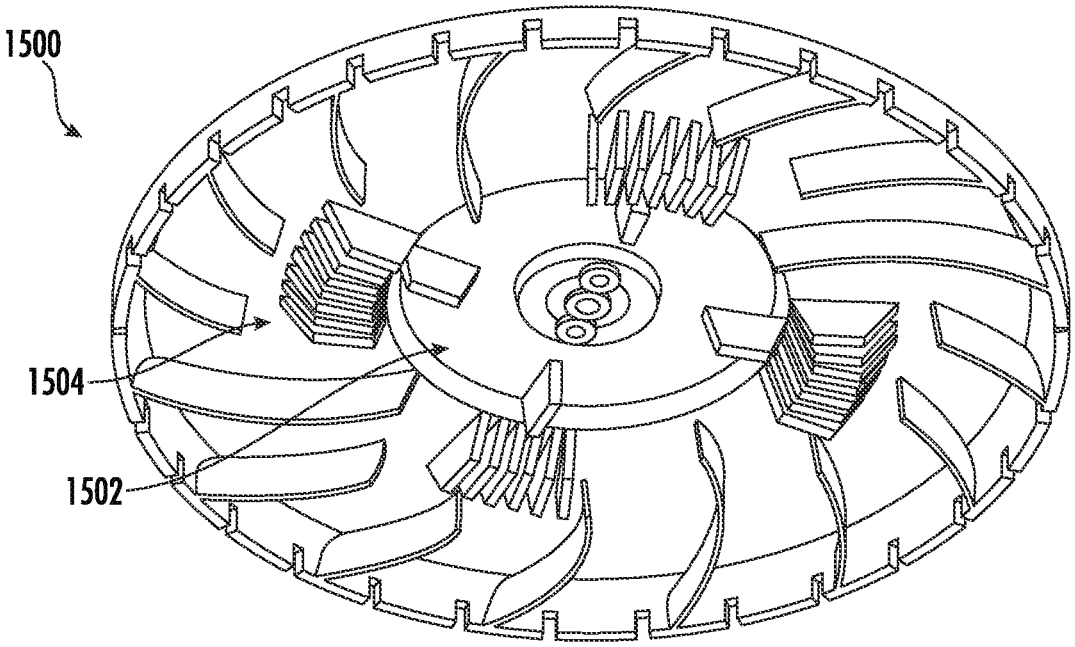
FIG. 15 shows a perspective view of an example of a pad holder configured to cooperate with the pad mount of FIG. 14, consistent with embodiments of the present disclosure.
Figure 16:
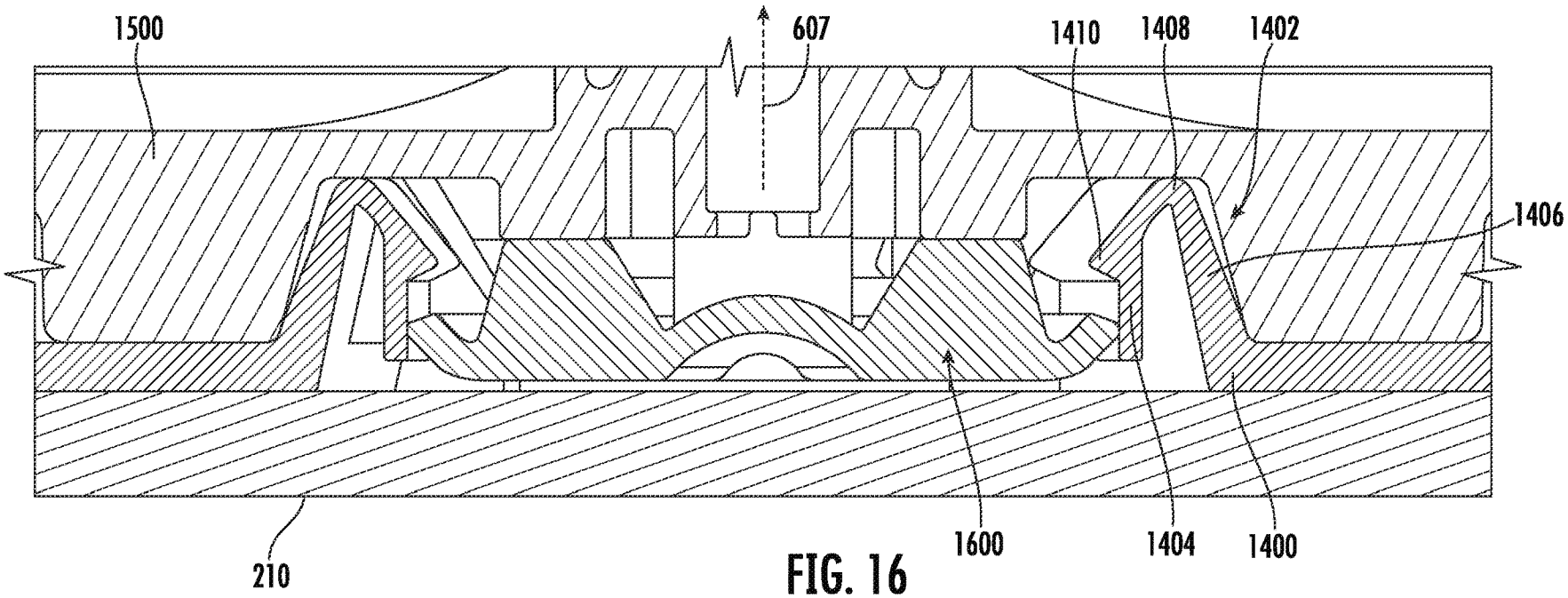
FIG. 16 shows a cross-sectional view of a portion of a pad holder of FIG. 15 having the cleaning pad of FIG. 2 mounted thereto using the pad mount of FIG. 14, consistent with embodiments of the present disclosure.

FIG. 14 shows an example of a pad mount 1400 configured to be used with the cleaning pad 210 and FIG. 15 shows an example of a pad holder 1500 configured to cooperate with the pad mount 1400 and FIG. 16 shows a cross-sectional view of a portion of a pad holder 1500 having the cleaning pad 210 mounted thereto using the pad mount 1400. As shown, the pad mount 1400 includes snap arms 1402 configured to releasably couple to a steam diffusion plate 1600 of the pad holder 1500. For example, the snap arms 1402 can be configured to form a snap fit connection with the steam diffusion plate 1600. The snap arms 1402 can extend in a direction of the pad rotation axis 607. For example, and as shown, the snap arms 1402 can generally be described as having a U-shape having a first snap leg 1404, a second snap leg 1406, and a connecting region 1408 connecting the first and second snap legs 1404 and 1406. The first snap leg includes a connector 1410 for coupling to the steam diffusion plate 1600. In operation, when a user couples the pad mount 1400, the steam diffusion plate 1600 urges the first snap leg 1404 towards the second snap leg 1406. Once connected, the first snap leg 1404 moves back towards a rest position and the connector 1410 couples the pad mount 1400 to the steam diffusion plate 1600.

The pad holder 1500 may include a pad mount receptacle 1502 and one or more pad alignment protrusions 1504 arranged about the pad mount receptacle 1502. The pad mount receptacle 1502 is configured to receive at least a portion of the pad mount 1400. The pad alignment protrusions 1504 are configured to encourage alignment of the pad mount 1400 when being coupled to the pad holder 1500.

Figure 17:
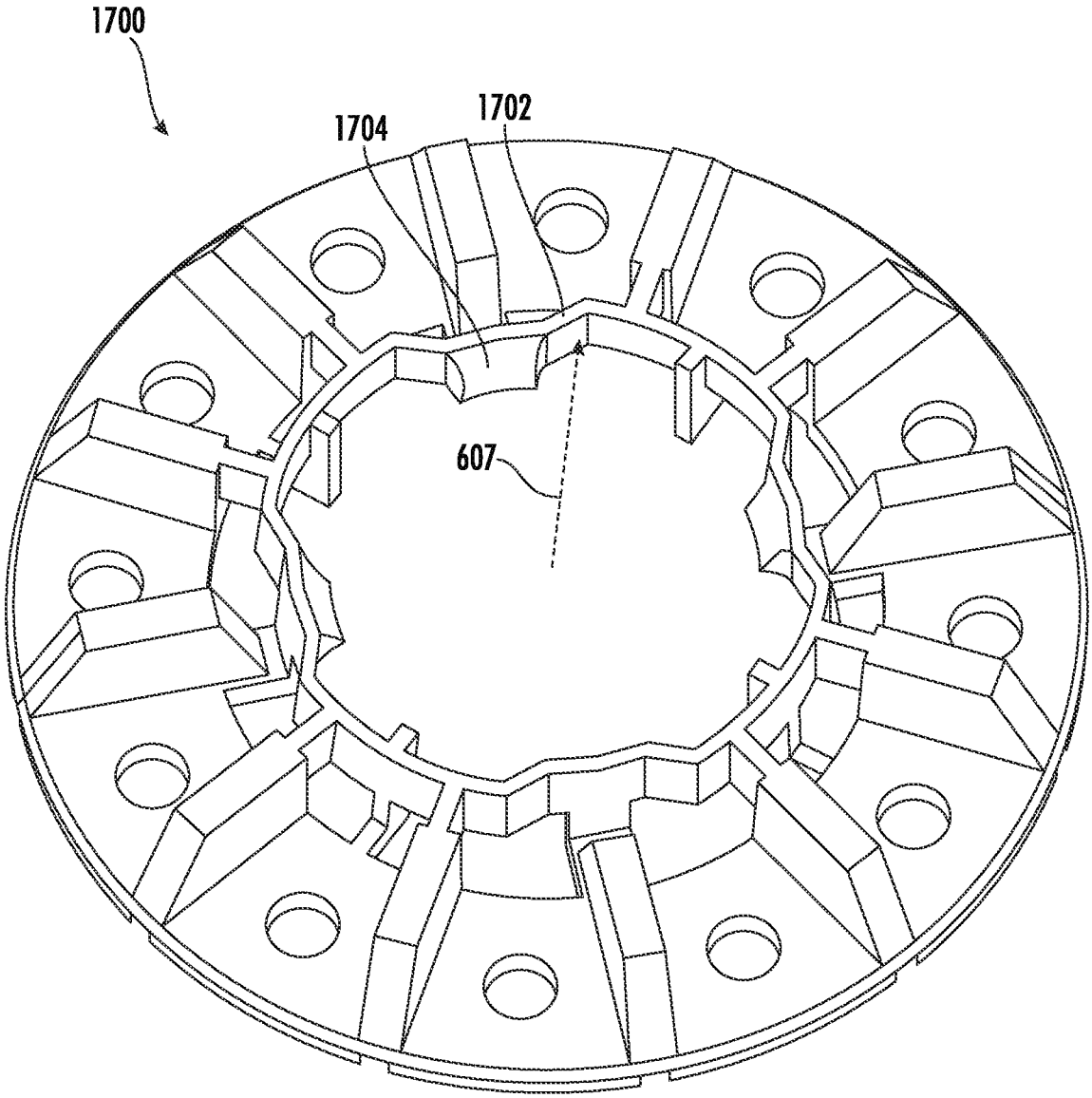
FIG. 17 shows a perspective view of an example of a pad mount configured to be used with the cleaning pad of FIG. 2, consistent with embodiments of the present disclosure.

FIG. 17 shows another example of a pad mount 1700 configured to form a snap-fit with the steam diffusion plate 1600. As shown, the pad mount 1700 includes a snap arm 1702 having a centrally located connector 1704. In operation, when a user couples the pad mount 1700 to the steam diffusion plate 1600, at least a portion of the central portion of the snap arm 1702 is urged in a direction away from the pad rotation axis 607. Once connected, the central portion of the snap arm 1702 moves back towards a rest position and the connector 1704 couples the pad mount 1700 to the steam diffusion plate 1600.

Figure 18:
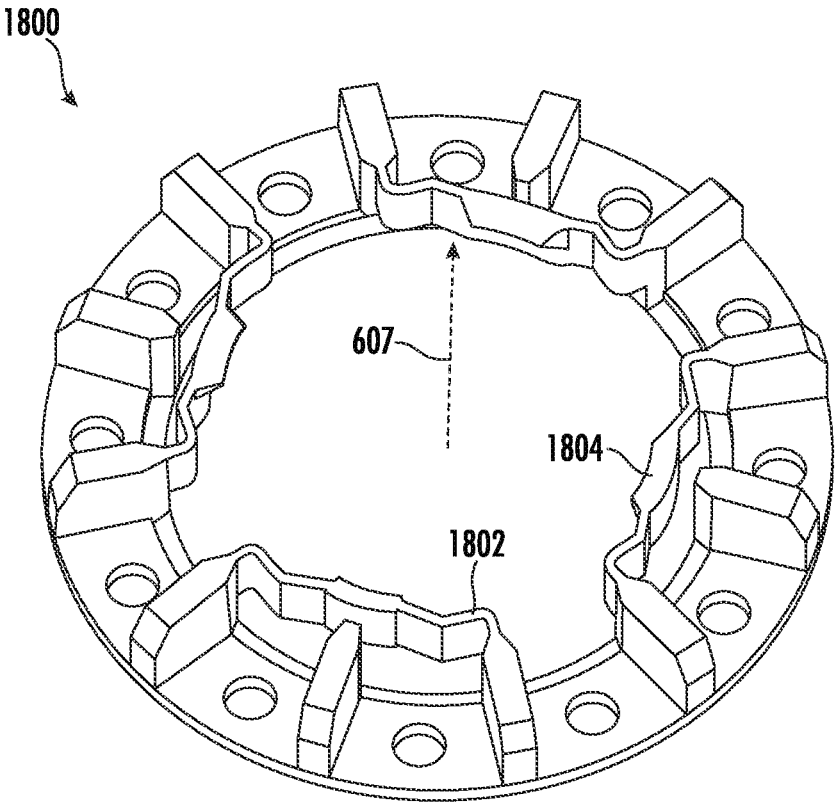
FIG. 18 shows a perspective view of an example of a pad mount configured to be used with the cleaning pad of FIG. 2, consistent with embodiments of the present disclosure.

FIG. 18 shows another example of a pad mount 1800 configured to form a snap-fit with the steam diffusion plate 1600. As shown, the pad mount 1800 includes a snap arm 1802 having a centrally located connector 1804. In operation, when a user couples the pad mount 1800 to the steam diffusion plate 1600, at least a portion of the central portion of the snap arm 1802 is urged in a direction away from the pad rotation axis 607. Once connected, the central portion of the snap arm 1802 moves back towards a rest position and the connector 1804 couples the pad mount 1800 to the steam diffusion plate 1600.

Figure 20:
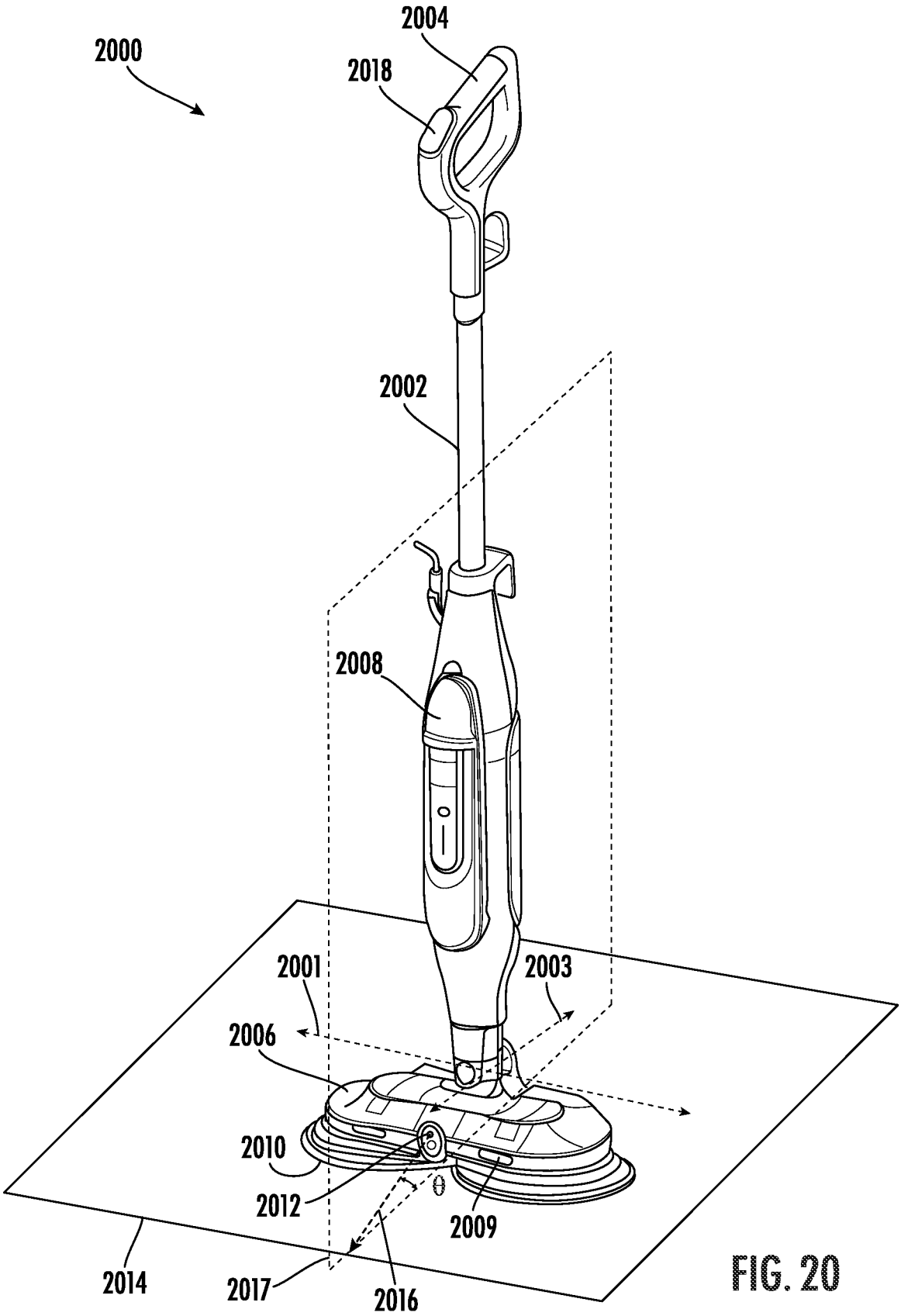
FIG. 20 shows a perspective view of a steam cleaning apparatus, consistent with embodiments of the present disclosure.

FIG. 20 shows a perspective view of an example of a steam cleaning apparatus 2000, which may be an example of the steam cleaning apparatus 100 of FIG. 1. As shown, the steam cleaning apparatus 2000 includes a wand 2002 having a handle 2004 pivotally coupled to a cleaning head 2006. For example, the wand 2002 may be configured to pivot about a first axis 2001 between a storage and an in-use position and to pivot about a second axis 2003 between a centered position and at least one side position. The first axis 2001 may extend transverse (e.g., perpendicular) to a forward direction of movement and the second axis 2003 may extend transverse (e.g., perpendicular) to the first axis 2001.

A cleaning assembly 2008 is coupled to the wand 2002 and fluidly coupled to the cleaning head 2006. The cleaning assembly 2008 is configured to generate steam that flows into the cleaning head 2006. As shown, the cleaning head 2006 includes a plurality of cleaning pads 2010 which are configured to rotate. In operation, steam is configured to pass through the cleaning pads 2010. As shown, the cleaning assembly 2008 may include one or more environment illuminating elements 2009 (e.g., one or more incandescent bulbs, one or more light emitting diodes, and/or any other lighting element) configured to illuminate at least a portion of a surrounding environment.

The cleaning head 2006 may further include a steam nozzle 2012. The steam nozzle 2012 is fluidly coupled to the cleaning assembly 2008 such that steam generated by the cleaning assembly 2008 passes through the steam nozzle 2012. The steam nozzle 2012 is configured to direct steam in a direction of a surface to be cleaned 2014 (e.g., a floor) along a steam axis 2016. The steam axis 2016 can be configured to intersect the surface to be cleaned 2014 at a location in front of the cleaning head 2006. Such a configuration may allow a user to apply steam to a location in the front of the cleaning head 2006 prior to positioning the cleaning pads 2010 at the location for scrubbing. The additional steam from the steam nozzle 2012 may soften debris adhered to the surface to be cleaned 2014. For example, and as shown, the steam axis 2016 may extend within a vertical plane 2017 that is disposed between the cleaning pads 2010 and intersects the cleaning assembly 2008. In some instances, the second axis 2003 may extend within the vertical plane 2017.

Figure 23:
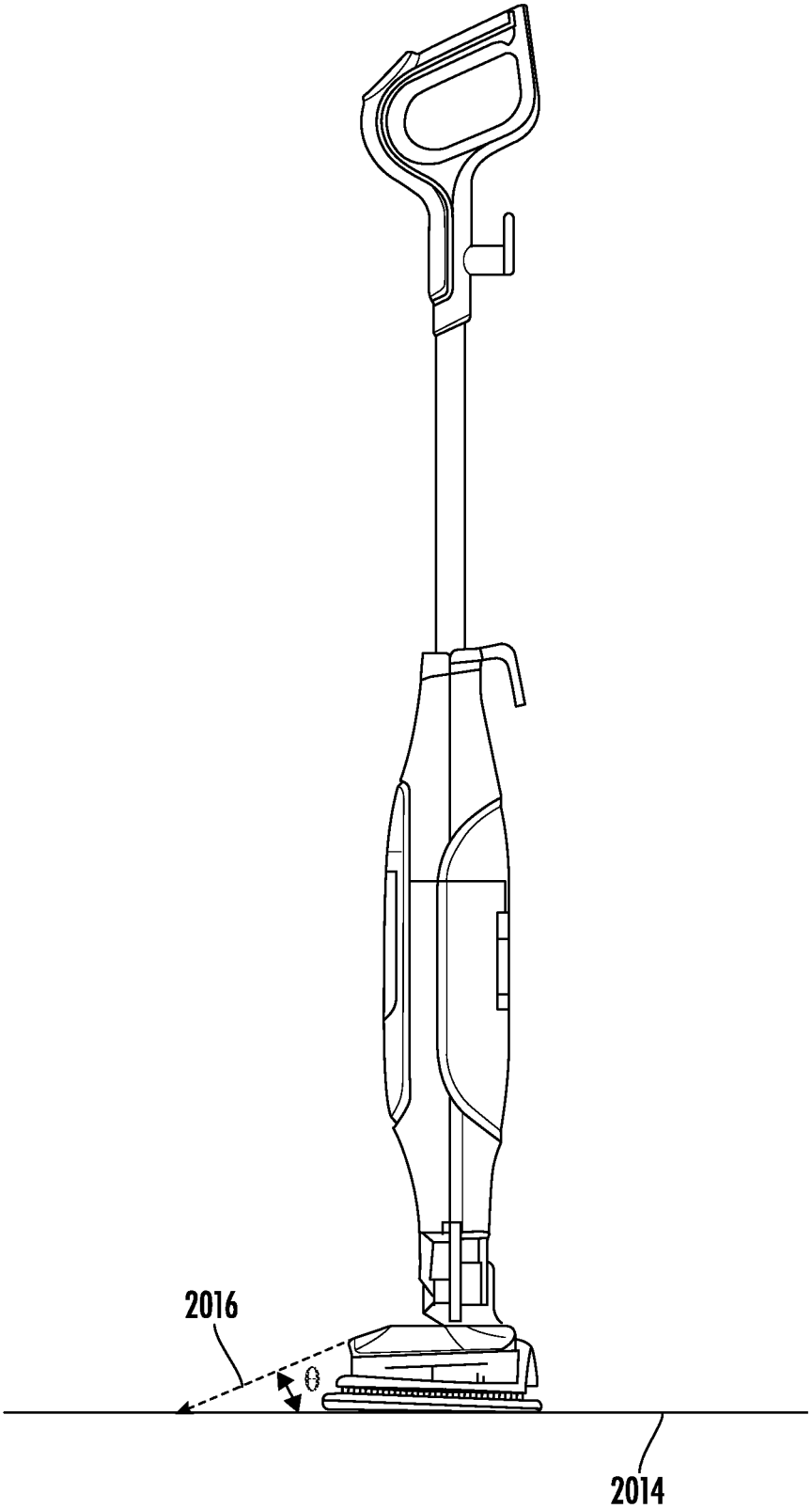
FIG. 23 shows a side view of the steam cleaning apparatus of FIG. 20, consistent with embodiments of the present disclosure.

The steam axis 2016 may form an intersection angle θ with the surface to be cleaned 2014 (see also, FIG. 23). The intersection angle θ may be in a range of, for example, 1° to 89°. By way of further example, the intersection angle θ may be in a range of 15° to 75°. By way of still further example, the intersection angle θ may be in a range of 20° to 70°. By way of still further example, the intersection angle θ may be in a range of 25° to 65°. By way of still further example, the intersection angle θ may be in a range of 30° to 60°. By way of still further example, the intersection angle θ may be in a range of 10° to 80°.

The handle 2004 can include a user interface 2018 (e.g., one or more buttons) configured to control one or more behaviors of the steam cleaning apparatus 2000. For example, the user interface 2018 may be configured to control an agitation speed (e.g., a rotation speed) of the cleaning pads 2010. By way of further example, the user interface 2018 may be configured to control a quantity of steam generated that passes through one or more of the cleaning pads 2010 and/or the steam nozzle 2012. By way of still further example, the user interface 2018 may be configured to control whether steam passes through only the cleaning pads 2010, only the steam nozzle 2012, and/or both the cleaning pads 2010 and the steam nozzle 2012.

Figure 21:
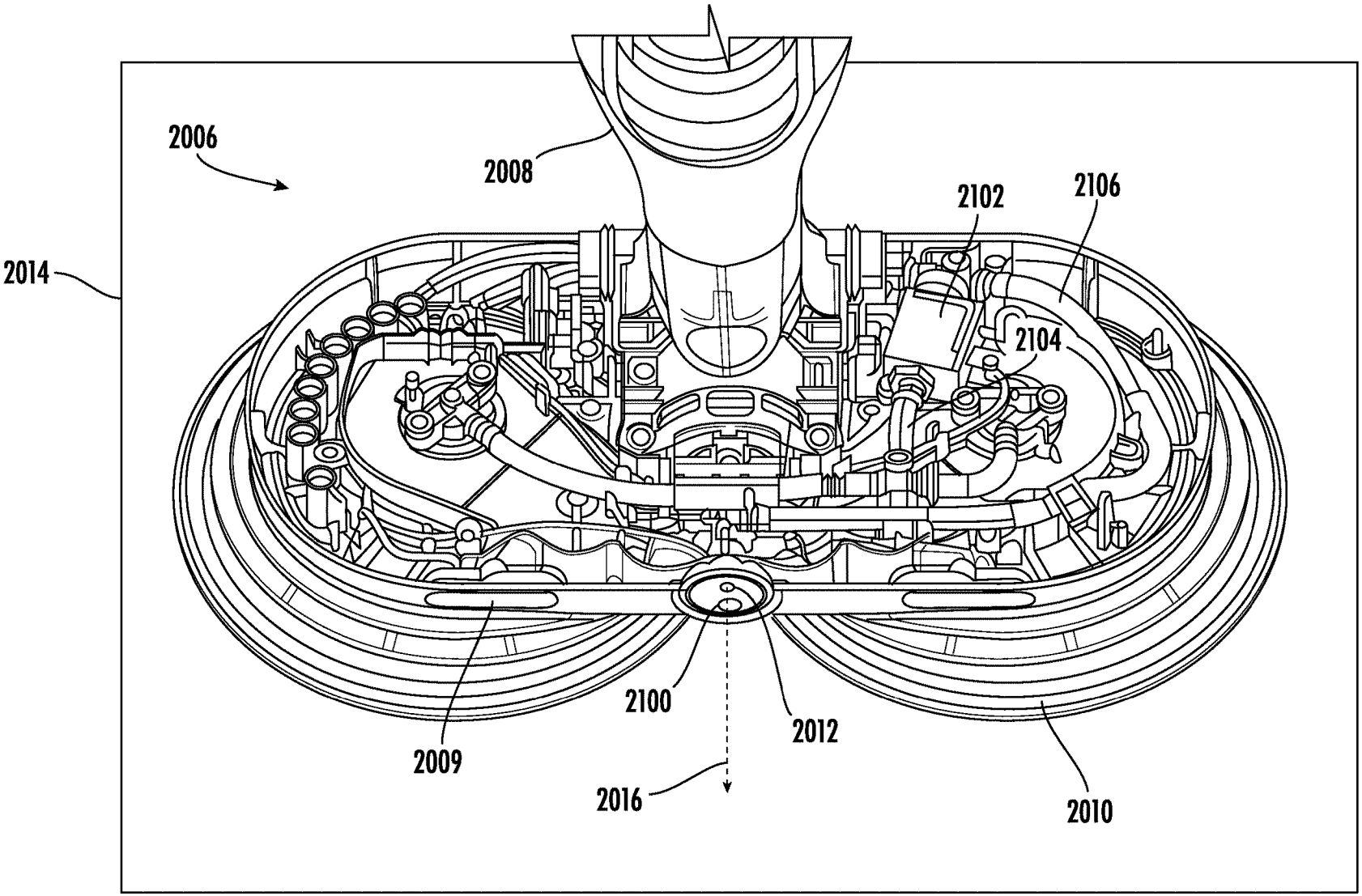
FIG. 21 shows a perspective view of a cleaning head of the steam cleaning apparatus of FIG. 20, wherein a portion of the cleaning head is removed therefrom for purposes of clarity, consistent with embodiments of the present disclosure.

As shown in FIG. 21, in some instances, the cleaning head 2006 may include one or more steam illuminating elements 2100 (e.g., one or more incandescent bulbs, one or more light emitting diodes, and/or any other lighting element). The one or more steam illuminating elements 2100 may be configured to illuminate a region of the surface to be cleaned 2014 within which the steam axis 2016 intersects the surface to be cleaned 2014. In some instances, the one or more steam illuminating elements 2100 may be configured to illuminate the surface to be cleaned 2014 before steam passes through the steam nozzle 2012, allowing a user to more readily identify the region of the surface to be cleaned 2014 where steam will be applied. Additionally, or alternatively, the one or more steam illuminating elements 2100 may be configured to illuminate the steam passing through the steam nozzle 2012. Such a configuration may allow a user to more readily confirm that steam is passing through the steam nozzle 2012.

As also shown in FIG. 21, the cleaning head 2006 includes a steam valve 2102. The steam valve 2102 is fluidly coupled to the cleaning assembly 2008. The steam valve 2102 is configured to selectively direct steam passing therethrough to one or both of the steam nozzle 2012 and/or each of the cleaning pads 2010. For example, the steam valve 2102 may be configured such that steam generated by the cleaning assembly 2008 is selectively delivered to only one of the steam nozzle 2012 or the cleaning pads 2010 as a time. The steam valve 2102 may include an off-position in which steam is substantially prevented from flowing through the steam valve 2102. The steam valve 2102 may be responsive to inputs received from the user interface 2018. For example, the steam valve 2102 may be an electronic valve such as a solenoid valve or motorized valve.

As shown, the steam valve 2102 is fluidly coupled a pad distribution line 2104 and a nozzle distribution line 2106. The pad distribution line 2104 fluidly couples the steam valve 2102 to the cleaning pads 2010 such that steam passes through the cleaning pads 2010. The nozzle distribution line 2106 fluidly couples the steam valve 2102 to the steam nozzle 2012. The distribution lines 2104 and 2106 may be an elastomeric (e.g., natural or synthetic rubber) tubing, a metal tubing, a plastic tubing, and/or any other tubing.

Figure 22:
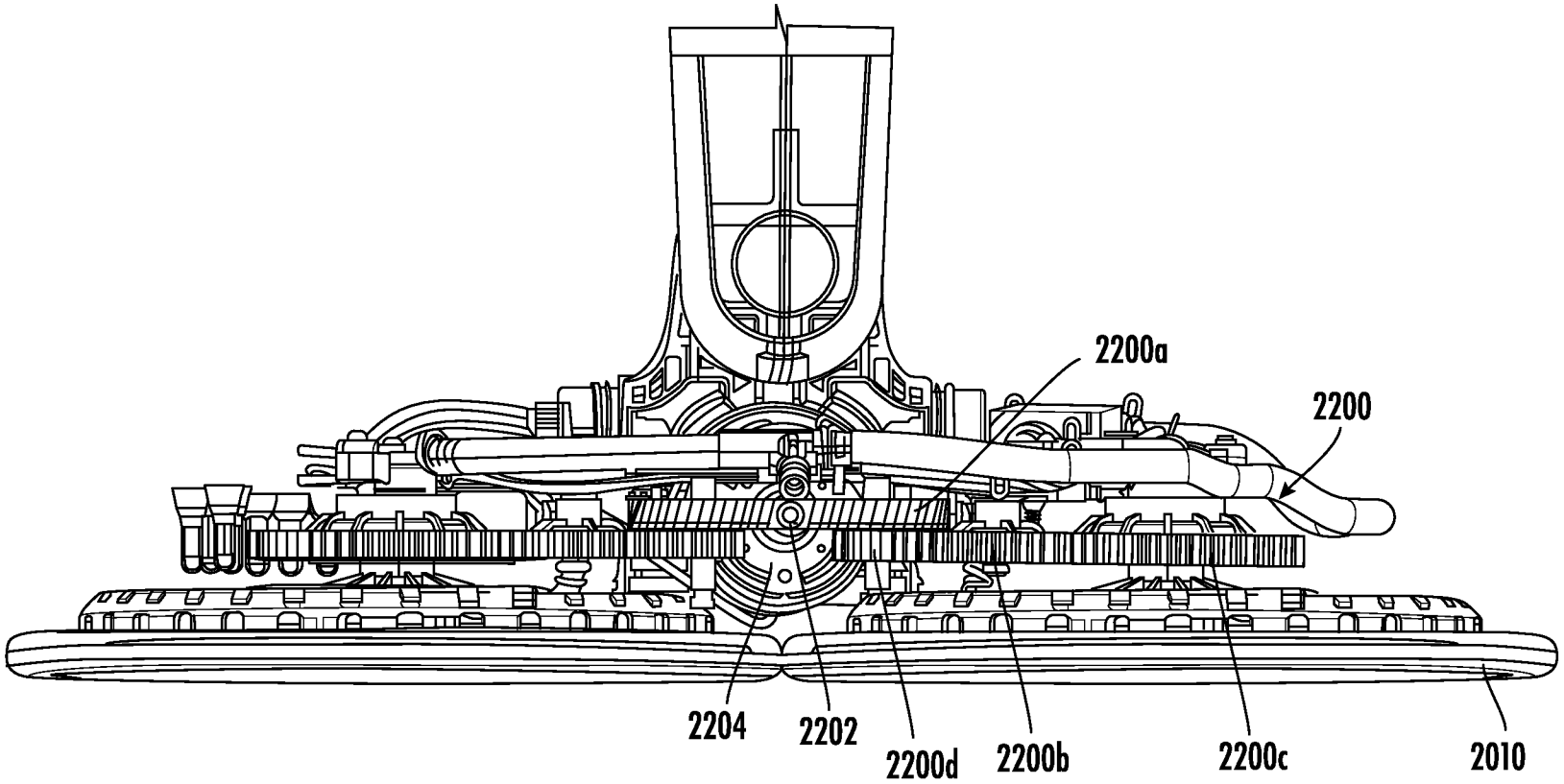
FIG. 22 shows another perspective view of a cleaning head of the steam cleaning apparatus of FIG. 20, wherein a portion of the cleaning head is removed therefrom for purposes of clarity, consistent with embodiments of the present disclosure.

As shown in FIG. 22, each of the cleaning pads 2010 are configured to rotate in response to a rotation of a plurality of gears 2200. As shown, the plurality of gears 2200 includes a plurality of worm gears 2200*a*, a plurality of intermediary gears 2200*b*, a plurality of pad gears 2200*c*, and a plurality of drive gears 2200*d*. A worm 2202 is configured to engage each of the worm gears 2200*a* such that each of the worm gears 2200*a* rotate in response to rotation of the worm 2202. The worm 2202 is coupled to a driveshaft of a pad motor 2204. As shown, each drive gear 2200*d* may be coupled to or integrally formed from a respective worm gear 2200*a*. Each drive gear 2200*d* is configured to engage a corresponding intermediary gear 2200*b* and each intermediary gear is configured to engage a corresponding pad gear 2200*c*. The plurality of gears 2200 and the worm 2202 may be generally described as a drivetrain configured to transfer rotational motion from the pad motor 2204 to each of the cleaning pads 2010.

An example of a steam cleaning apparatus, consistent with the present disclosure, may include a wand, a cleaning assembly coupled to the wand, the cleaning assembly including a steam generator, and a cleaning head pivotally coupled to the wand. The cleaning head may include a plurality of cleaning pads, a pad motor having a motor driveshaft, a drivetrain coupling the pad motor to each of the plurality of cleaning pads such that a rotation of the motor driveshaft causes a corresponding rotation in each of the plurality of cleaning pads, and a temperature sensor positioned proximate to the drivetrain, the temperature sensor being configured to measure a temperature of the drivetrain.

In some instances, the drivetrain may include a worm coupled to the motor driveshaft. In some instances, the drivetrain may include a plurality of worm gears configured to engage with the worm, a plurality of intermediary gears each configured to engage with a respective worm gear, and a plurality of pad gears each configured to engage with a respective intermediary gear. In some instances, the temperature sensor may be positioned proximate to the worm. In some instances, each pad gear may be coupled to a corresponding pad holder such that each pad holder rotates with a corresponding pad gear. In some instances, each pad holder may include a steam distribution cavity and a pad driveshaft defining a steam channel that is fluidly coupled to the steam distribution cavity and the cleaning assembly. In some instances, the steam distribution cavity may include a plurality of ribs extending within the steam distribution cavity, the plurality of ribs extending radially outward from a pad rotation axis. In some instances, each rib may include a plurality of rib protrusions that are configured to engage with a corresponding cleaning pad. In some instances, a first plurality of rib protrusions corresponding to a first rib may be radially offset from a plurality of rib protrusions corresponding to an immediately adjacent rib. In some instances, the pad driveshaft may include a coupling configured to couple the pad holder to the drivetrain. In some instances, the coupling may include a coupling body having a first end and a second end, the first end is spaced apart from the second end such that the coupling body partially encloses an area. In some instances, the coupling body may include a plurality of arcuate regions, wherein immediately adjacent arcuate regions are separated by a recessed region. In some instances, each pad holder may include one or more steam outlets fluidly coupled to the steam distribution cavity. In some instances, the one or more steam outlets may be configured to divert steam passing therethrough such that the diverted steam does not pass through the plurality of cleaning pads. In some instances, each cleaning pad may include a pad mount, the pad mount having an annular base and one or more mount protrusions extending from the annular base.

Another example of steam cleaning apparatus, consistent with the present disclosure, may include a wand, a cleaning assembly coupled to the wand, the cleaning assembly including a steam generator, and a cleaning head pivotally coupled to the wand. The cleaning head may include a plurality of cleaning pads, a pad motor having a motor driveshaft, and a drivetrain coupling the pad motor to each of the plurality of cleaning pads such that a rotation of the motor driveshaft causes a corresponding rotation in each of the plurality of cleaning pads, the drivetrain including a drive bevel gear coupled to the motor driveshaft, a plurality of step-down bevel assemblies, and a plurality pad bevel gears.

In some instances, each step-down bevel assembly may include a first step-down bevel gear and a second step-down bevel gear, each coupled to a gear driveshaft, the first step-down bevel gear engaging the drive bevel gear and the second step-down bevel gear engaging the pad bevel gear. In some instances, each gear driveshaft may be supported by one or more thrust bearings. In some instances, each pad bevel gear may be coupled to a corresponding pad holder such that each pad holder rotates with a corresponding pad bevel gear. In some instances, each pad holder may include a steam distribution cavity and a pad driveshaft defining a steam channel that is fluidly coupled to the steam distribution cavity and the cleaning assembly. In some instances, the steam distribution cavity may include a plurality of ribs extending within the steam distribution cavity, the plurality of ribs extending radially outward from a pad rotation axis. In some instances, each rib may include a plurality of rib protrusions that are configured to engage with a corresponding cleaning pad. In some instances, a first plurality of rib protrusions corresponding to a first rib may be radially offset from a plurality of rib protrusions corresponding to an immediately adjacent rib. In some instances, the pad driveshaft may include a coupling configured to couple the pad holder to the drivetrain. In some instances, the coupling may include a coupling body having a first end and a second end, the first end is spaced apart from the second end such that the coupling body partially encloses an area. In some instances, the coupling body may include a plurality of arcuate regions, wherein immediately adjacent arcuate regions are separated by a recessed region. In some instances, each pad holder may include one or more steam outlets fluidly coupled to the steam distribution cavity. In some instances, the one or more steam outlets may be configured to divert steam passing therethrough such that the diverted steam does not pass through the plurality of cleaning pads. In some instances, each cleaning pad may include a pad mount, the pad mount having an annular base and one or more mount protrusions extending from the annular base.

An example of a steam cleaning apparatus, consistent with the present disclosure, may include a wand, a cleaning assembly coupled to the wand, the cleaning assembly including a steam generator, and a cleaning head pivotally coupled to the wand. The cleaning head may include a plurality of cleaning pads, a pad motor having a motor driveshaft, a drivetrain configured to transfer rotational motion of the motor driveshaft to each of the plurality of cleaning pads such that a rotation of the motor driveshaft causes a corresponding rotation in each of the plurality of cleaning pads, and a temperature sensor positioned proximate to the drivetrain, the temperature sensor being configured to measure a temperature of the drivetrain.

In some instances, the drivetrain may include a worm coupled to the motor driveshaft. In some instances, the drivetrain may include a plurality of worm gears configured to engage with the worm, a plurality of intermediary gears each configured to engage with a respective worm gear, and a plurality of pad gears each configured to engage with a respective intermediary gear. In some instances, the temperature sensor may be positioned proximate to the worm. In some instances, each pad gear may be coupled to a corresponding pad holder such that each pad holder rotates with a corresponding pad gear. In some instances, each pad holder may include a steam distribution cavity and a pad driveshaft defining a steam channel that is fluidly coupled to the steam distribution cavity and the cleaning assembly. In some instances, the steam distribution cavity may include a plurality of ribs extending within the steam distribution cavity, the plurality of ribs extending radially outward from a pad rotation axis. In some instances, each rib may include a plurality of rib protrusions that are configured to engage with a corresponding cleaning pad. In some instances, a first plurality of rib protrusions corresponding to a first rib may be radially offset from a plurality of rib protrusions corresponding to an immediately adjacent rib. In some instances, the pad driveshaft may include a coupling configured to couple the pad holder to the drivetrain. In some instances, the coupling may include a coupling body having a first end and a second end, the first end is spaced apart from the second end such that the coupling body partially encloses an area. In some instances, the coupling body may include a plurality of arcuate regions, wherein immediately adjacent arcuate regions are separated by a recessed region. In some instances, each pad holder may include one or more steam outlets fluidly coupled to the steam distribution cavity. In some instances, the one or more steam outlets may be configured to divert steam passing therethrough such that the diverted steam does not pass through the plurality of cleaning pads. In some instances, each cleaning pad may include a pad mount, the pad mount having an annular base and one or more mount protrusions extending from the annular base. In some instances, the drivetrain may include a drive bevel gear coupled to the motor driveshaft, a plurality of step-down bevel assemblies, and a plurality pad bevel gears and, wherein, each step-down bevel assembly may include a first step-down bevel gear and a second step-down bevel gear, each coupled to a gear driveshaft, the first step-down bevel gear engaging the drive bevel gear and the second step-down bevel gear engaging the pad bevel gear, each gear driveshaft being supported by one or more thrust bearings and each pad bevel gear being coupled to a corresponding pad holder such that each pad holder rotates with a corresponding pad bevel gear.

Another example of a steam cleaning apparatus, consistent with the present disclosure, may include a wand, a cleaning assembly coupled to the wand, the cleaning assembly including a steam generator, and a cleaning head pivotally coupled to the wand. The cleaning head may include a plurality of cleaning pads, a pad motor configured to rotate each of the plurality of cleaning pads, a steam nozzle, and a steam valve fluidly coupled to the cleaning assembly, the steam valve being configured to selectively direct steam passing therethrough to at least one of the steam nozzle or each of the plurality of cleaning pads.

In some instances, the steam valve may be a solenoid valve. In some instances, the steam nozzle may be configured to emit steam along a steam axis, the steam axis intersecting a surface to be cleaned. In some instances, the cleaning head may further include a steam illuminating element configured to illuminate a region of the surface to be cleaned within which the steam axis intersects the surface to be cleaned.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A steam cleaning apparatus comprising:

a wand;

a cleaning assembly coupled to the wand, the cleaning assembly including a steam generator; and a cleaning head pivotally coupled to the wand, the cleaning head including:

a plurality of cleaning pads;

a pad motor having a motor driveshaft;

a drivetrain configured to transfer rotational motion of the motor driveshaft to each of the plurality of cleaning pads such that a rotation of the motor driveshaft causes a corresponding rotation in each of the plurality of cleaning pads, wherein the drivetrain includes a worm and a plurality of worm gears configured to be rotated by the worm; and a temperature sensor positioned directly above the worm, such that a central axis of the worm is aligned with a central axis of the temperature sensor when the steam cleaning apparatus is in-use to clean a floor, the temperature sensor being configured to measure a temperature corresponding to the drivetrain, wherein, when the temperature exceeds a temperature threshold, the pad motor is disabled, the temperature threshold being based, at least in part, on a temperature sensitivity of a material of at least one of the worm gears.

2. The steam cleaning apparatus of claim 1, wherein the worm is coupled to the motor driveshaft.

3. The steam cleaning apparatus of claim 2, wherein the drivetrain includes a plurality of intermediary gears each configured to engage with a respective worm gear and a plurality of pad gears each configured to engage with a respective intermediary gear.

4. The steam cleaning apparatus of claim 3, wherein each pad gear is coupled to a corresponding pad holder such that each pad holder rotates with a corresponding pad gear.

5. The steam cleaning apparatus of claim 4, wherein each pad holder includes a steam distribution cavity and a pad driveshaft defining a steam channel that is fluidly coupled to the steam distribution cavity and the cleaning assembly.

6. The steam cleaning apparatus of claim 5, wherein the steam distribution cavity includes a plurality of ribs extending within the steam distribution cavity, the plurality of ribs extending radially outward from a pad rotation axis.

7. The steam cleaning apparatus of claim 6, wherein each rib includes a plurality of rib protrusions that are configured to engage with a corresponding cleaning pad.

8. The steam cleaning apparatus of claim 7, wherein a first plurality of rib protrusions corresponding to a first rib are radially offset from a second plurality of rib protrusions corresponding to an immediately adjacent rib.

9. The steam cleaning apparatus of claim 5, wherein the pad driveshaft includes a coupling configured to couple the pad holder to the drivetrain.

10. The steam cleaning apparatus of claim 9, wherein the coupling includes a coupling body having a first end and a second end, the first end is spaced apart from the second end such that the coupling body partially encloses an area.

11. The steam cleaning apparatus of claim 10, wherein the coupling body includes a plurality of arcuate regions, wherein immediately adjacent arcuate regions are separated by a recessed region.

12. The steam cleaning apparatus of claim 5, wherein each pad holder includes one or more steam outlets fluidly coupled to the steam distribution cavity.

13. The steam cleaning apparatus of claim 12, wherein the one or more steam outlets are configured to divert steam passing therethrough such that the diverted steam does not pass through the plurality of cleaning pads.

14. The steam cleaning apparatus of claim 1, wherein each cleaning pad includes a pad mount, the pad mount having an annular base and one or more mount protrusions extending from the annular base.

* * * * *